US005203552A

United States Patent [19]

Hoshi et al.

[11] Patent Number: 5,203,552

[45] Date of Patent: Apr. 20, 1993

[54] SHEET FEEDING APPARATUS

[75] Inventors: Akimitsu Hoshi, Kawasaki; Masaaki Sato, Yokohama; Takaji Yonemori, Kawasaki; Hideki Goto, Tokyo, all of Japan

[73] Assignee: Canon Kabushiki Kaisha, Tokyo, Japan

[21] Appl. No.: 625,890

[22] Filed: Dec. 11, 1990

[30] Foreign Application Priority Data

Dec. 11, 1989 [JP] Japan ..... 1-321649

[51] Int. Cl.[5] ..... B65H 3/44

[52] U.S. Cl. ..... 271/9; 271/164

[58] Field of Search ..... 271/9, 162, 164

[56] References Cited

U.S. PATENT DOCUMENTS 4,709,915 12/1987 Ishikawa et al. .
4,864,368 9/1989 Muramatsu ..... 271/164 X
4,883,265 11/1989 Iida et al. .
4,917,364 4/1990 Iida et al. .
5,021,837 6/1991 Uto et al. .
5,052,670 10/1991 Makiura ..... 271/164 X

FOREIGN PATENT DOCUMENTS 63-127934 5/1988 Japan .
2-163224 6/1990 Japan .
2-163227 6/1990 Japan .
2-163228 6/1990 Japan .

*Primary Examiner*—Richard A. Schacher
*Attorney, Agent, or Firm*—Fitzpatrick, Cella, Harper & Scinto

[57] ABSTRACT

A sheet feeding apparatus for feeding a sheet to a sheet receiving device includes a first unit having at least one stacking tray for stacking sheets; a first feeder for feeding the sheet from the stacking tray of the first unit; a first guiding member for guiding the sheet from the first feeder to the receiving device; a second guiding member for guiding a side of the sheet opposite from a side guided by the first guiding member to constitute together with the first guiding member a sheet passage; a second unit having at least one stacking tray for stacking sheets; second feeder for feeding the sheet from the stacking tray of the second unit; a third guiding member for guiding the sheet from the second feeder to the receiving device; and a supporting device for supporting the first unit to the second unit for movement between a first position wherein the first guiding member guides the sheet from the first feeder and a second position wherein at least one of the first guiding member and the second guiding member are exposed.

52 Claims, 30 Drawing Sheets

SHEET FEEDING APPARATUS

FIELD OF THE INVENTION AND RELATED ART

The present invention relates to a sheet feeding apparatus detachably mountable to an image forming apparatus.

When a conventional sheet feeding apparatus separable from said an image forming apparatus is used, the entirety of the sheet feeding apparatus is moved away from the image forming apparatus to provide space therebetween to carry out a jam clearance operation.

In this case, the sheet feeding apparatus is easily influenced by the condition of the top surface of the floor (unevenness or inclination). The influence includes undue force at the joint therebetween or positional deviation therebetween with the possible result of improper sheet feeding. In addition, if the number of sheet accommodated in the sheet feeding apparatus increased, the weight of the apparatus becomes large, and therefore, it required a large force move the entirety of the apparatus when the sheet is jammed. Therefore, there is a limit in the sheet capacity.

SUMMARY OF THE INVENTION

Accordingly, it is a principal object of the present invention to provide a sheet feeding apparatus in which a jammed sheet is easily removed.

It is another object of the present invention to provide a sheet feeding apparatus wherein the jammed sheet can be removed without difficulty, and a large number of sheets can be accommodated.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to FIGS. 1-23, an embodiment of the present invention will be described. A sheet feeding apparatus according to the embodiment is in the form of a front loading deck having a large capacity and attachable to a side of a copying machine which is an exemplary image forming apparatus. It has a separable upper and lower units. Upon occurrence of sheet jam, the upper unit is slidable to open the sheet passage.

Figure 1:
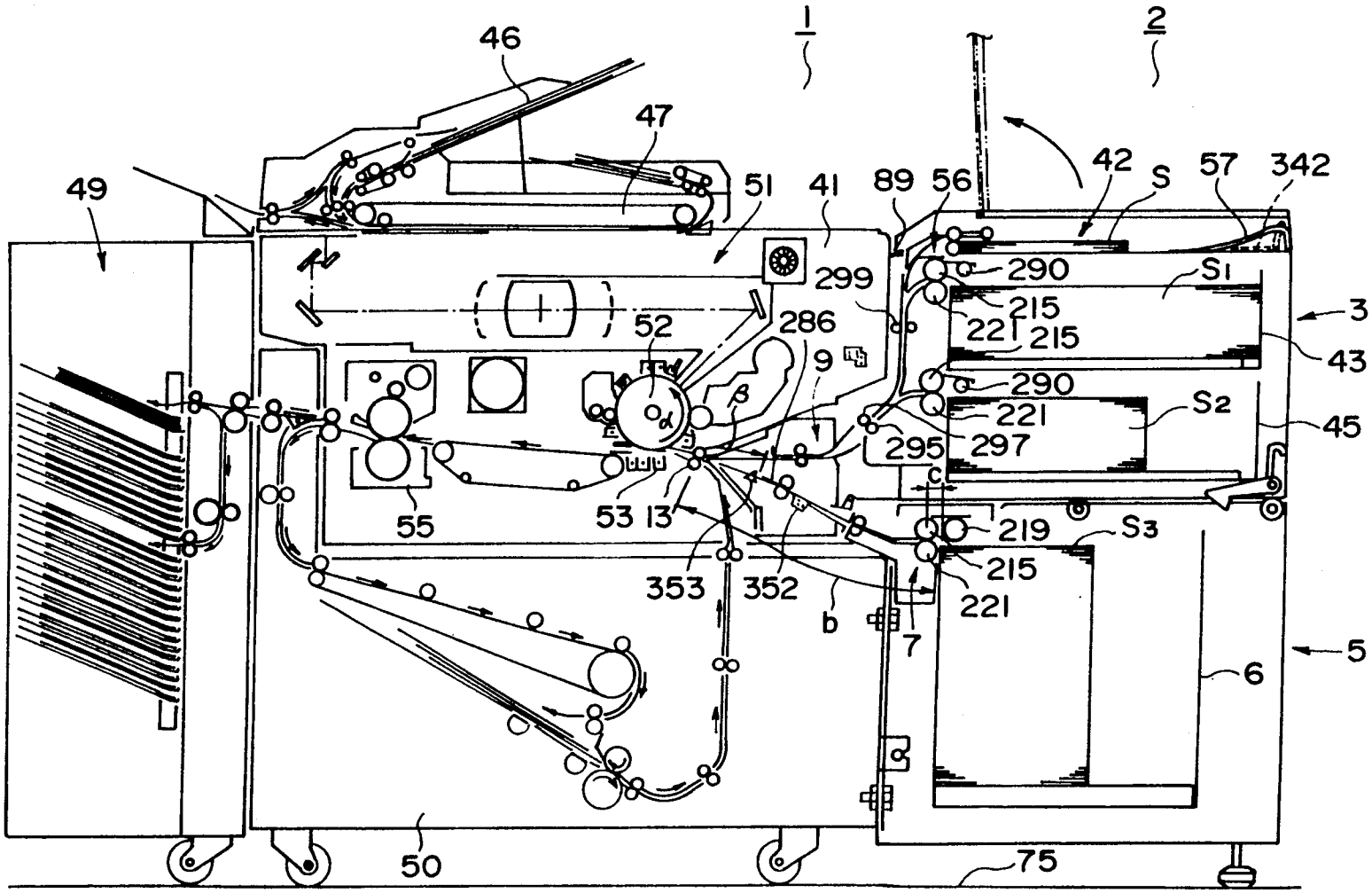
FIG. 1 shows a general arrangement of a copying machine and a sheet feeding apparatus according to a first embodiment of the present invention.

In FIG. 1, the sheet feeding apparatus 2 is connected with a main assembly 41 of the copying machine 1 (image forming apparatus). It has an upper unit 3 and a lower unit 5 which are vertically arranged and separable from each other. The upper unit 3 has a manual feeding station capable of stacking approximately 50 sheets S, an upper deck 43 and middle deck 45 capable of stacking approximately 1000 sheets S, and the lower unit 5 has a lower deck 6 capable of stacking approximately 3000 sheets S.

The copying machine 1 is designed so as to be used with cassettes containing sheets. In order to operatively couple the sheet feeding apparatus 2 of this embodiment with the copying machine 1, the unit of the cassette feeding station of the copying machine 1 is replaced as a whole with a suitable guide and roller coupled to constitute a sheet conveying passages of the sheet feeding apparatus 2. The sheet conveyance passages for this purpose are called hereinafter "an interface unit". The interface unit has passages connected with the upper unit 3 and the lower unit 5, as will be described hereinafter.

The detail of the structure of the sheet feeding apparatus according to this embodiment will be described in conjunction with FIGS. 1-23.

FIG. 1 is a longitudinal sectional view of the sheet feeding apparatus 2 and the copying machine 1 connected thereto. The copying system including the copying machine 1 comprises an original handling device 43 disposed at the top of the copying machine 1 and effective to automatically feeding originals 46, a post processing device 49 such as a sorter, and an automatic duplex printing device 50 which functions as a base for supporting the copying machine 1 and which functions to form images on both sides of a sheet S.

In the main assembly 41, there are an optical system 51 for scanning the originals 46, a photosensitive drum 52 on which a toner image is formed by the exposure through the optical system 51 and by a developing device, an image transfer station 53 for transferring the toner image onto the sheet S and an image fixing device 55 for fixing the toner image, and the like.

The sheet feeding apparatus 2 is generally constituted by eight units, namely, the upper unit 3, the lower unit 5 which are vertically arranged and separable from each other, a manual sheet feeding station 42 above the upper unit 3, the upper deck 43 in the upper unit 3, a lower deck 45 in the upper unit 3, an upper sheet feeding unit 56 for feeding the sheets S out of the decks 43 and 45, a lower deck 6 in the lower unit 5 and a lower sheet feeding unit 7 for feeding the sheets out of the lower deck 6. The sheet feeding apparatus 2 is provided with the interface unit 9 which replaces the cassette sheet feeding unit provided originally in the copying machine 1.

Figure 2:
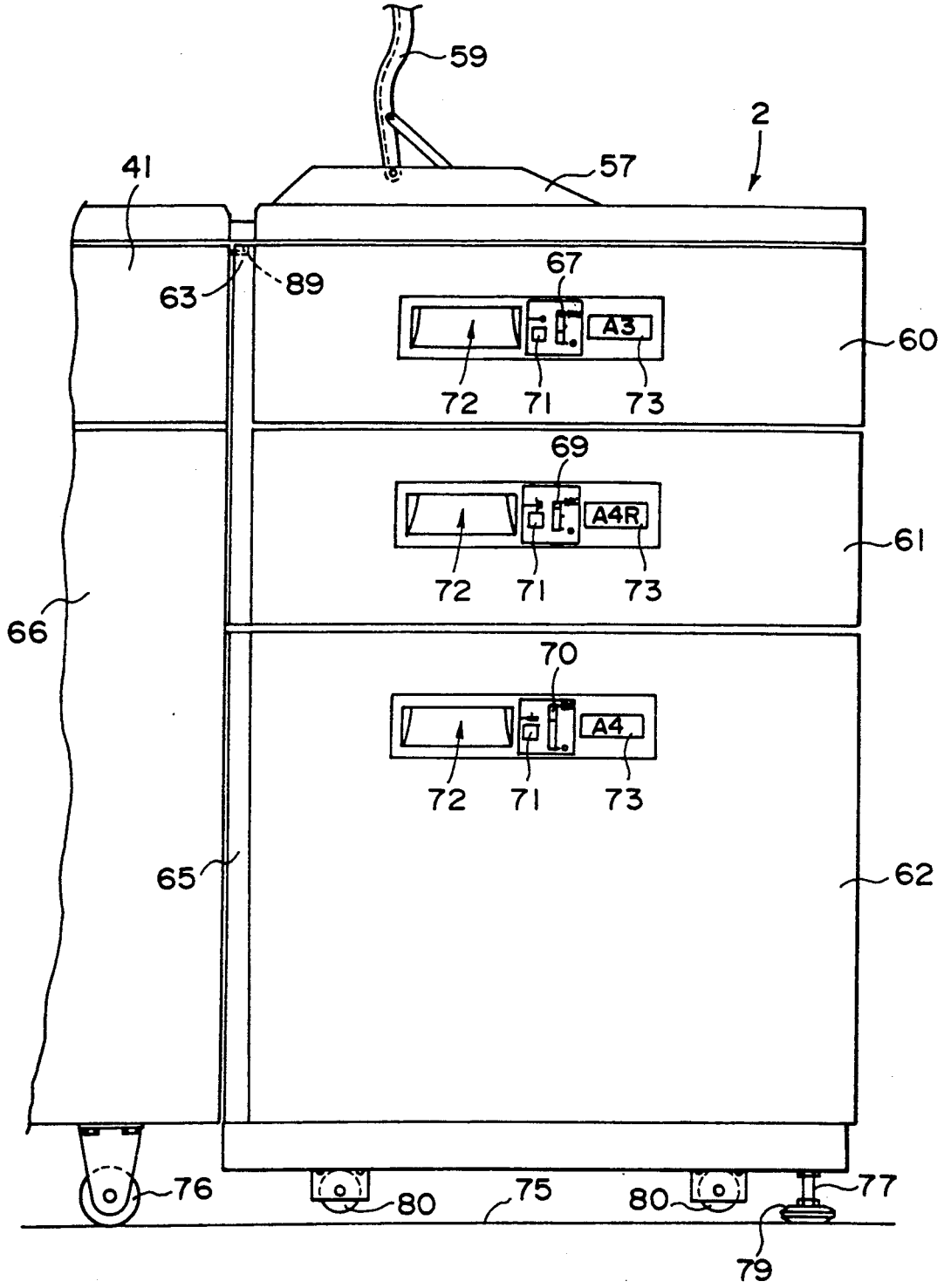
FIG. 2 is a front view of the sheet feeding apparatus.

FIG. 2 is a front view of the sheet feeding apparatus 2. The top of the sheet feeding apparatus 2 is provided with a cover 57 for covering the manual feeding station 42. The cover 57 has an openable transparent cover 59 to prevent foreign matter such as dust from the entering the manual sheet feeding station 42. The space between the main assembly 41 of the copying machine 1 and front covers 60, 61 and 62 of the decks 43, 45 and 46 of the sheet feeding apparatus 2 is covered by gap covers 63 and 65.

Figure 3:
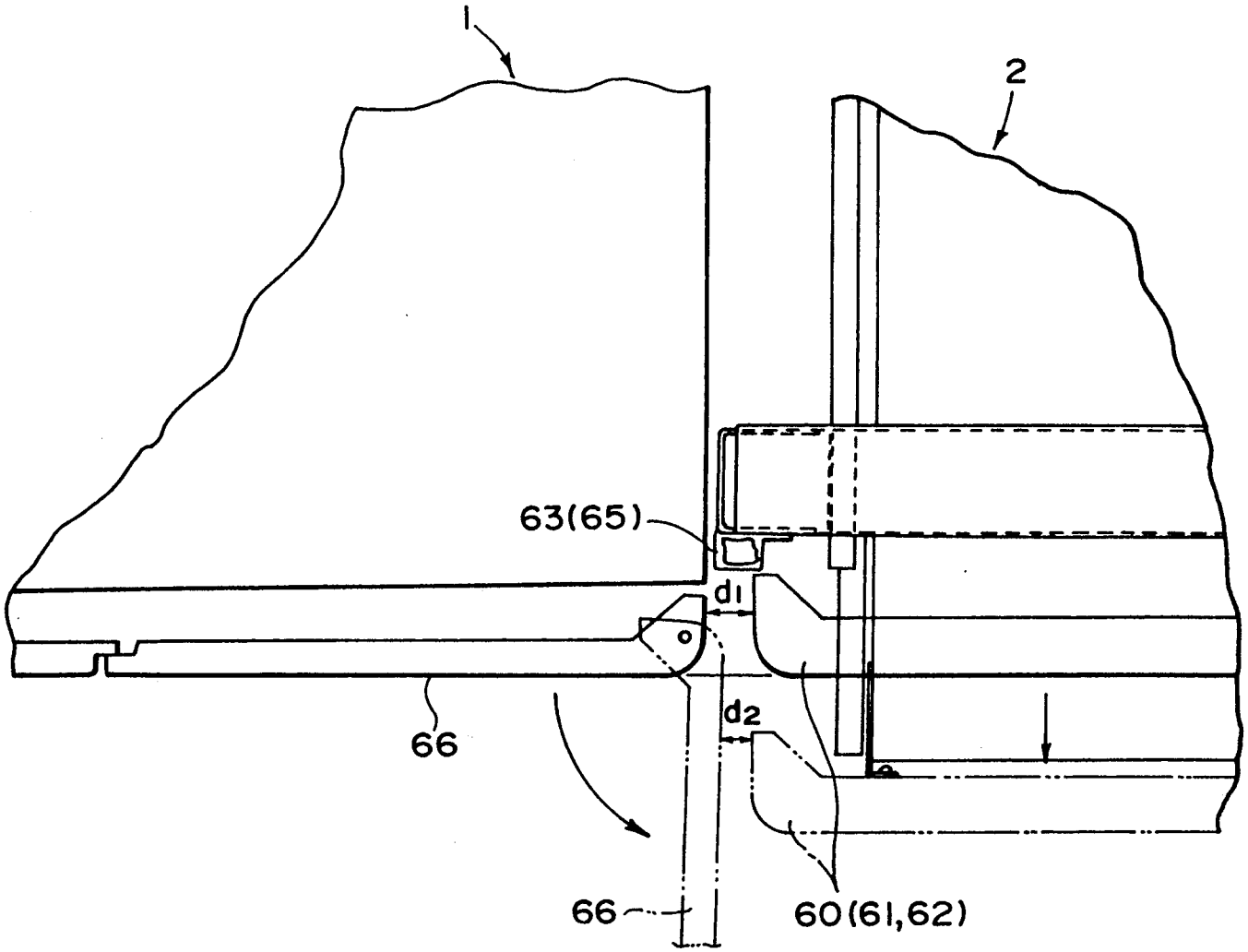
FIG. 3 is a top plan view thereof.

FIG. 3 is a top plan view of the sheet feeding apparatus 2 of FIG. 2. As will be understood from this Figure, the front door 66 of the copying machine 1 is substantially flush with the front cover 60, 61 and 62. A clearance $d_1$ is required to prevent interference among the front door 66, the decks 43, 45 and 46, when the front door 66 is opened or when the decks 43, 45 and 46 are drawn out. The above described covers 63 and 65 cover the clearance $d_1$.

In FIG. 2, the front covers 60, 61 and 63 are provided with remainder displays 67, 69 and 70 for displaying remainder amounts of the sheets S of the decks 43, 45 and 6. Since the lower deck 6 has the capacity of 3000 sheets, the length of the remainder display is larger than those of the other. The decks 67, 69 and 70 are locked against drawing out, by electric solenoid, as will be described in conjunction with FIG. 14.

A releasing switch 71 functions to release the locking. When the releasing switch 71 is depressed, a lifter of each of the decks 43, 45 and 6 lowers, and the locking is released, so that the decks 43, 45 and 6 are permitted to be drawn out. Each of the front covers 60, 61 and 62 is provided with a grip 72 and a sheet size display 73.

To the bottom surface of the main assembly 41, plural casters 76 ar fixed in contact with the floor 75. The bottom surface of the sheet feeding apparatus 2 is provided with legs 77 having adjusters 79 adjacent the free end of the sheet feeding apparatus 2, and is provided with plural casters 80. When the sheet feeding apparatus 2 is set relative to the copying machine, the casters 80 is away from the surface of the floor 75, and therefore, the sheet feeding apparatus 2 is supported by the casters 76.

Figure 4:
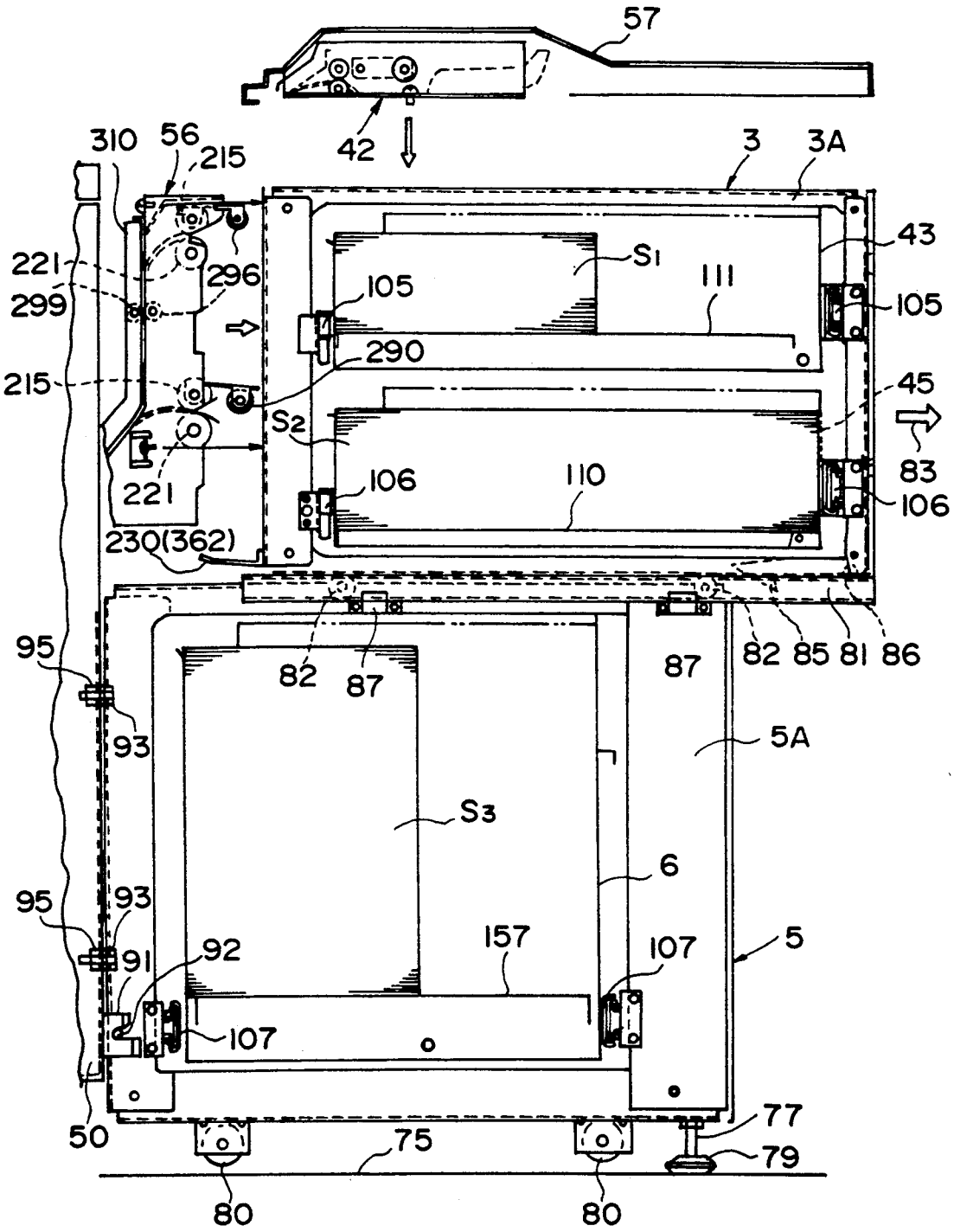
FIGS. 4 and 5 are sectional front views thereof.

FIG. 4 shows the inside of the apparatus when the front covers 60, 61 and 62 at the gap covers 63 and 65 are dismounted. Rails 81 fixedly mounted on a frame 3a of the upper unit 3 are slidably supported on a frame 5A of the lower unit 5 through a bearing 82, so that the upper unit 3 is slidable in the direction indicated by an arrow 83. A locking pawl 85 is mounted on the frame 3a about a pin 86. By engaging and disengaging the locking pawl 85 with one of the bearings 82, by which the upper unit 3 is locked or released.

A rail guide 87 fixedly mounted on the frame 5A is provided only for the front side rail 81 of the front and rear rails 81. As shown in FIG. 6, when the upper unit 3 is slid, it guides the rail 81 for the rectilinear movement. FIG. 6 is a side view as seen from the right of FIG. 5. In FIGS. 1 and 2, between the main assembly 41 of the copying machine 1 and the manual feeding station 42, a receiving member 89 which opens upwardly is fixedly mounted on the main assembly 41. The receiving member 89 is effective to prevent the foreign matter such as paper clip or the like from falling to the sheet feed passage.

Referring to FIGS. 4 and 6, the description will be made as to how to set the sheet feeding apparatus 2 relative to the main assembly 41 of the copying machine 1.

In FIG. 4, to the bottom of the main assembly 41, there is fixedly mounted a positioning member 91 having upper and lower arms constituting a groove. A positioning pin 92 engageable with and disengageable from the positioning member 91 is fixedly mounted on the frame 5A. When the sheet feeding apparatus 2 is set, the positioning pin 92 is engaged with the positioning member 91, by which the sheet feeding apparatus 2 is correctly positioned relative to the main assembly 41. The lower arm of the positioning member 91 is slightly longer than the upper arm, and they constitute a guide. When the sheet feeding apparatus 2 is set, the lower unit 5 is pushed to the main assembly 41 with the positioning pin 92 on the lower arm extending horizontally. When the lower unit 5 is brought into contact with the automatic duplex copying device 50 functioning as the base for supporting the copying machine, the lower unit 5 is positioned only in the vertical direction.

Then, the adjuster 79 is operated so that the level of the sheet feeding apparatus 2 is adjusted to be at the same level as the main assembly 41. Finally, the frame 5A of the lower unit 5 and the frame of the automatic duplex copying device 50 are securedly fixed by bolts 93 and nuts 95, by which the sheet feeding apparatus 2 is correctly positioned in the lateral direction (left-right direction), and is connected with the copying machine. At the end, the caster 80 of the sheet feeding apparatus 2 is away from the floor 75, and therefore, the sheet feeding apparatus 2 can be correctly connected with the copying machine 1 even if the floor 75 is more or less waved.

The positioning pin 92 is provided at each of the front and rear sides. The vertical positioning of the sheet feeding apparatus adjacent the main assembly 41 is not as is disclosed in Japanese Laid-Open Patent Application No. 127934/1988 in which the sheet feeding apparatus is simply placed on the floor. Therefore, the sheet feeding apparatus 2 is correctly positioned relative to the copying machine in this embodiment. The vertical positioning of the sheet feeding apparatus 2 is effected about a pivot in the form of a pin, and therefore, the sheet feeding apparatus 2 is rotatable when the adjuster 79 is operated, and therefore, the horizontal adjustment can be effected without difficulty.

In FIG. 6, the positioning of the sheet feeding apparatus 2 in the left-right direction, is accomplished by sandwiching the front part 3*a* of the frame 5A by the positioning member 91. The rear positioning member 91*a* supports the rear side of the lower unit 5. The positioning member 91*a* provides a wider space so that it does not nip with strong force the rear part 5*b* of the frame 5A.

Figure 21:
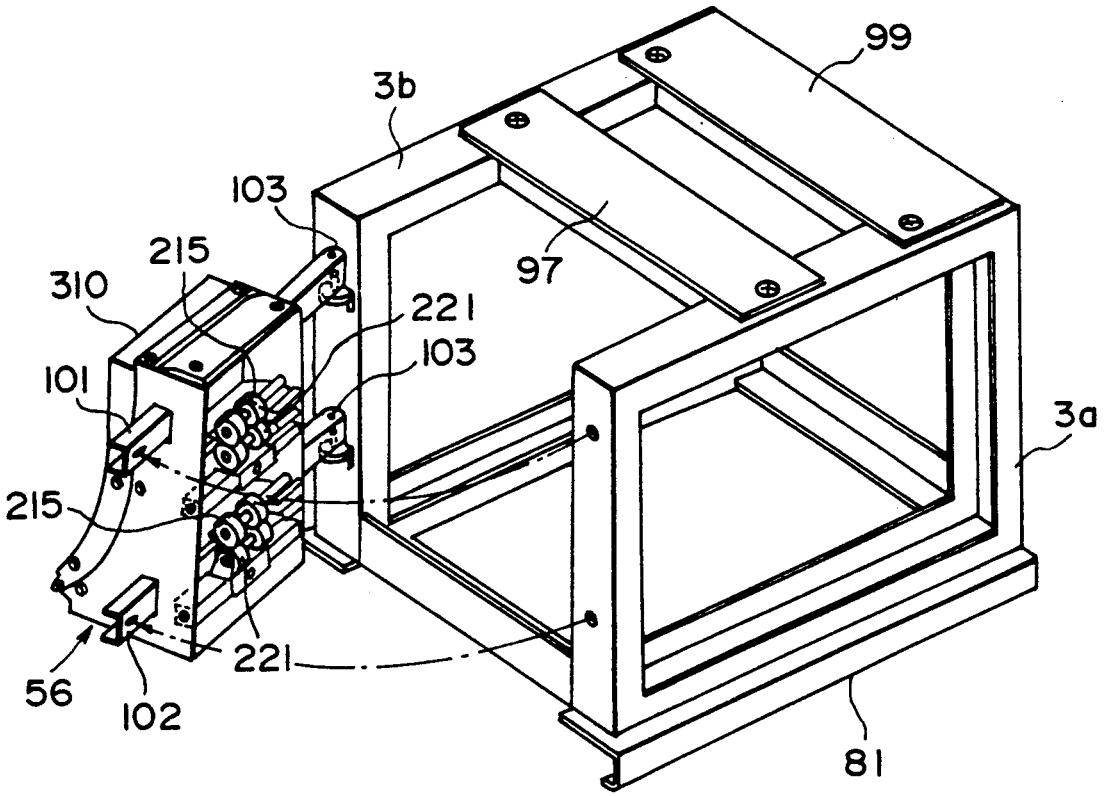
FIG. 21 is a perspective view of the upper sheet feeding unit.

FIG. 21 is a perspective view of the structure of the frame 3A of the upper unit 3. Frames 3A and 3B each in the form of a window are fixed by bottom stays 96, top stays 97 and corner stays and the like. The frames 3A and 3B are produced by welding, and the accuracy and the rigidity of the entire sheet feeding apparatus 2 is maintained by the frames 3A and 3B.

Figure 5:
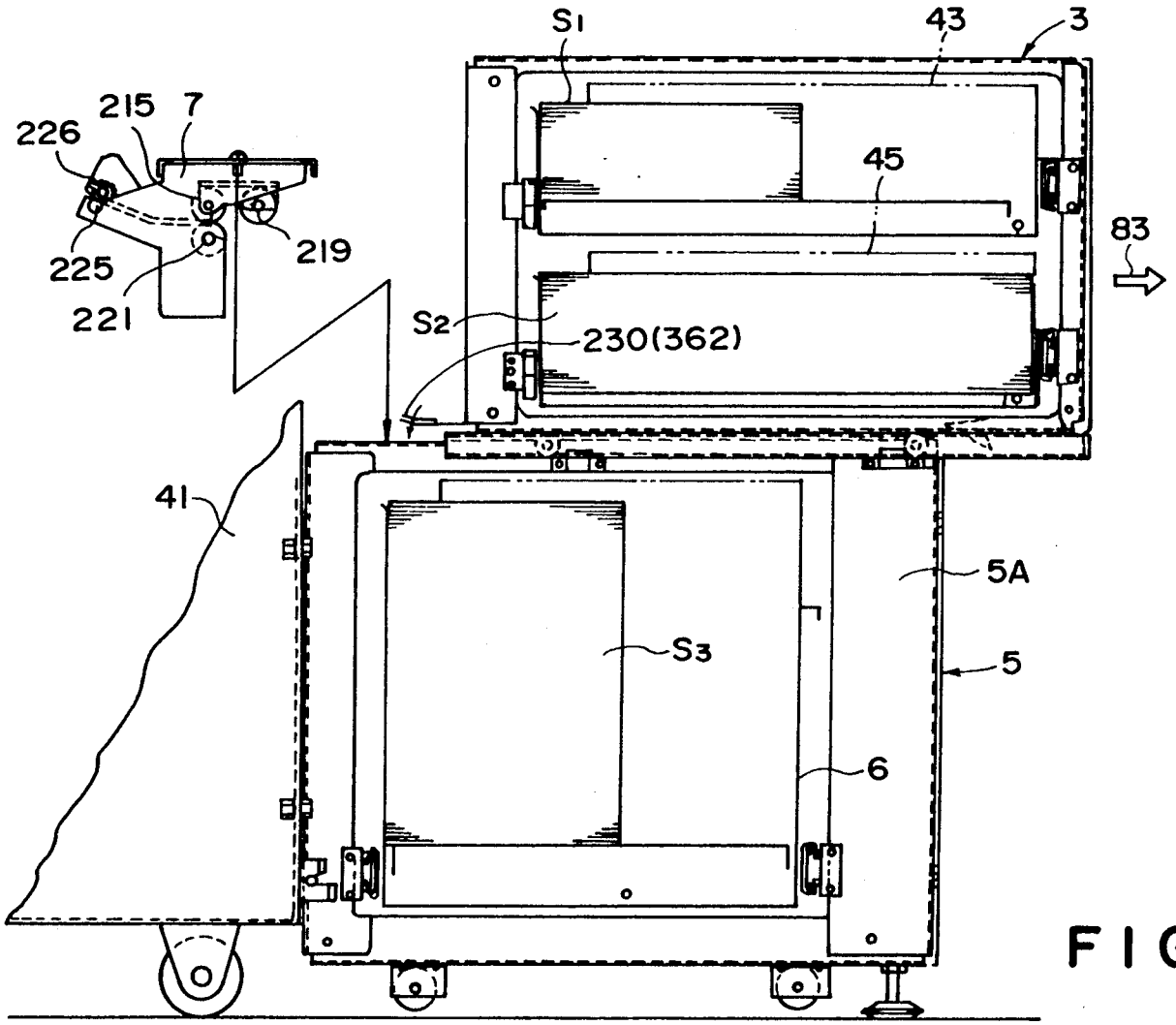
Figure 6:
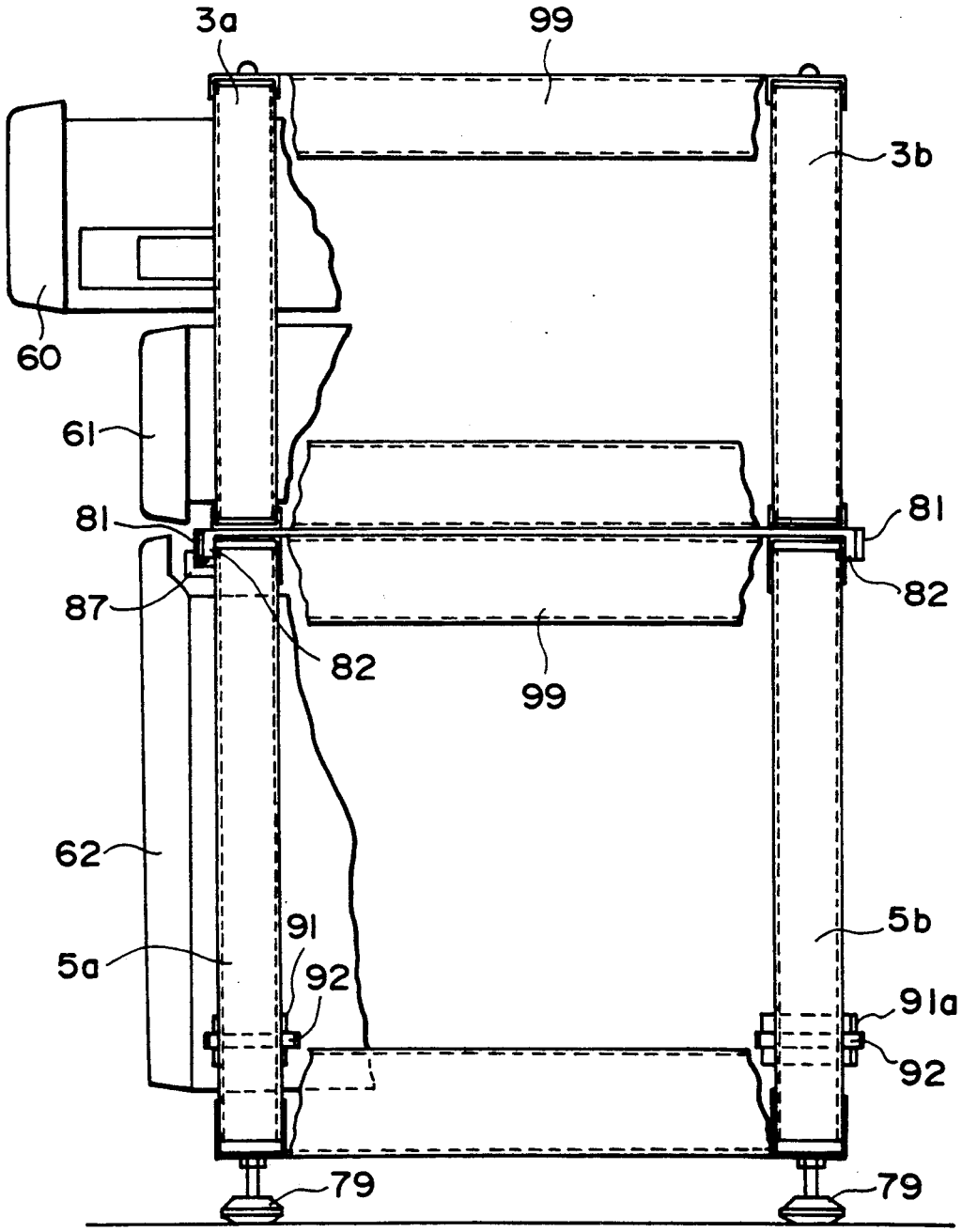
FIG. 6 is a perspective view of the sheet feeding apparatus as seen from the right side of FIG. 4.

Referring to FIGS. 4 and 5, the structures of the units of the sheet feeding apparatus 2 will be described.

The upper unit 3 and the lower unit 5 have been dealt with in the foregoing, and the description thereof will be omitted here. The manual sheet feeding device 42 is mounted to the top of the frame 3A by screws. The upper sheet feeding unit 56 is mounted from the left side of the upper unit 3 so that it can be mounted or dismounted when the upper unit 3 is slid in the direction 83 (FIG. 4). The upper sheet feeding unit 56 is slidably supported on the upper and lower stays 101 and 102 (FIG. 21). The base portions of the stays 101 and 102 are rotatably mounted on the frame 3*b* about a pin 103 (FIG. 21). Since the upper sheet feeding unit 56 is mounted on the frame 3*b* with a hinge structure, the mounting and the servicing of the upper sheet feeding unit 56 is improved.

As shown in FIG. 5, the lower sheet feeding unit 7 is mounted from the top of the frame 5A, and is mounted by screws. In this case, the upper unit 3 is slid in the front-rear direction (left-right direction in FIG. 5), so that the mounting and dismounting of the lower sheet feeding unit 7 is permitted. As shown in FIG. 4 the upper/middle decks 43 and 45 are mounted in the frame 3A through rails 105 and 106, so that they can be drawn out to the front. The lower deck 6 is drawably mounted in the frame 5A on plural rails 107.

Figure 7:
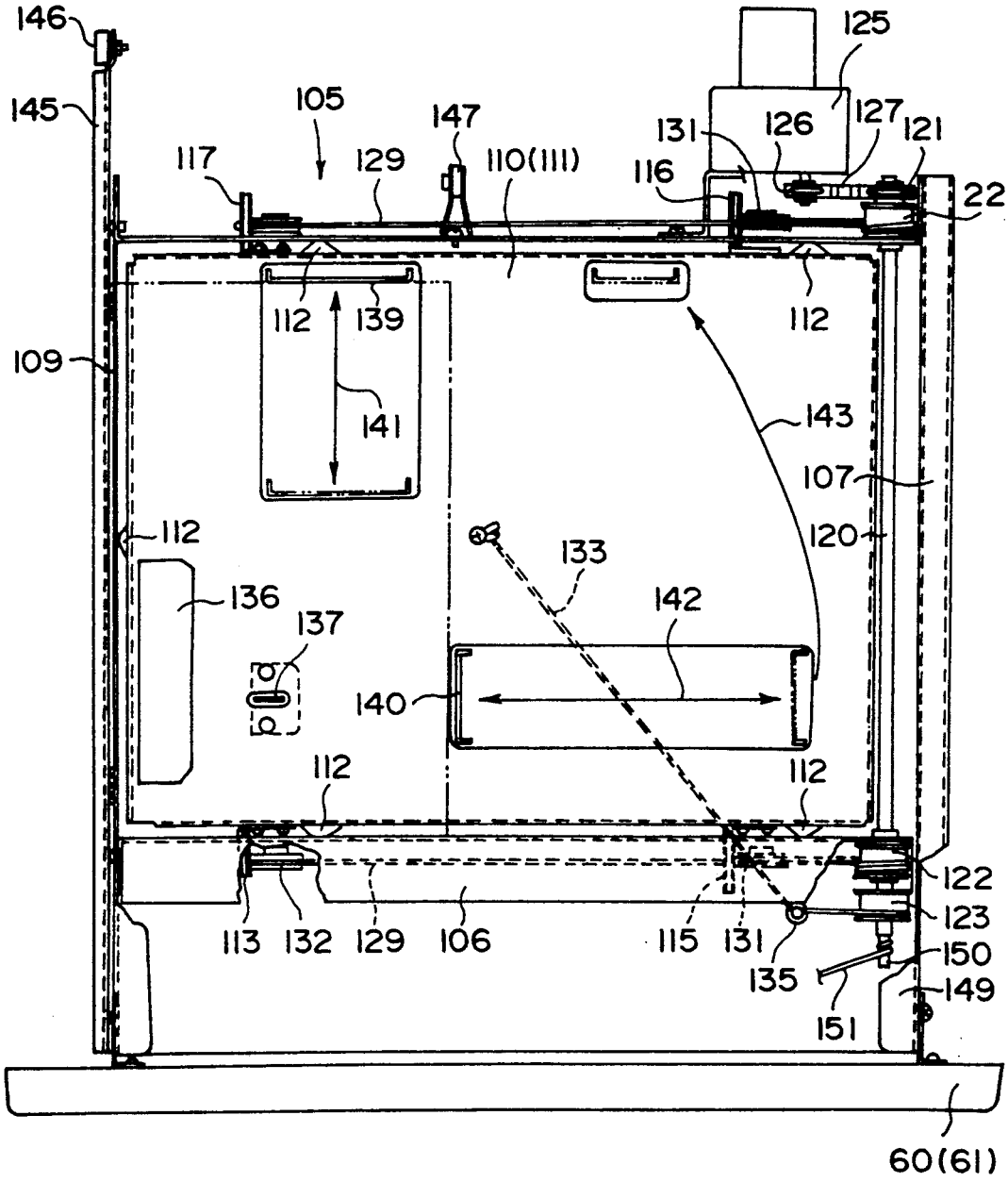
FIG. 7 is a top plan view of an upper/lower deck.
Figure 8:
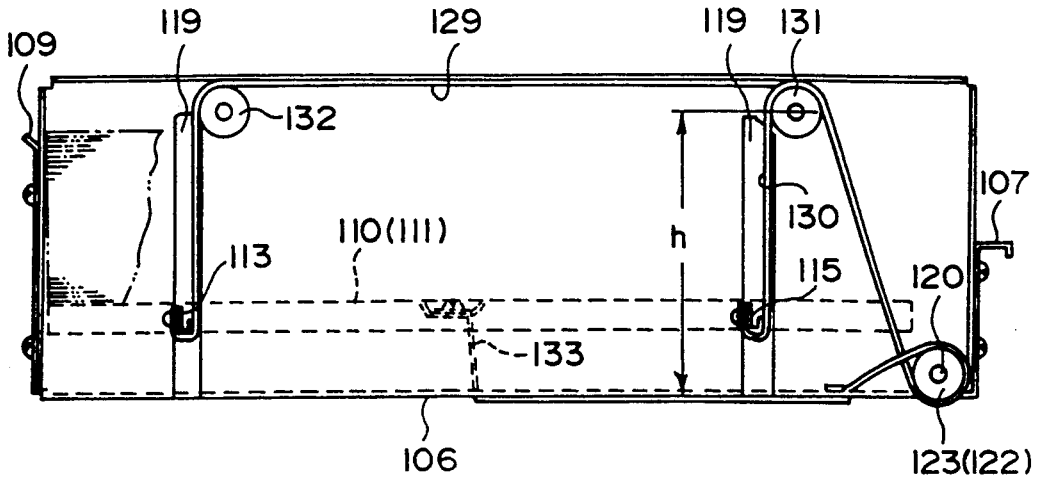
FIG. 8 is a front view thereof.

Referring to FIGS. 7 and 8, the upper/middle decks 43 and 45 will be described.

The upper and middle decks 43 and 45 are constituted by the same parts. The only difference is in the position where they are mounted on the front panels 60 and 61, and therefore, in the Figures, the same reference numerals are assigned to the corresponding elements.

A casing 105 for the upper or middle deck 43 or 45 is constituted as a box opening upwardly, with a bottom casing 105 in the form of a channel, a right side plate 107 and a left side plate 109. In the casing 105, there is a lifter plate 110 (111) for stacking the sheets S. To a side of the lifter plate 110 (111), a slide member 112 is mounted to permit sliding in the casing 105. T the side of the lifter plate 110 (111), four wire fixing elements 113, 115, 116 and 117 are fixedly mounted. They protrude through slits 119 formed in the side wall of the bottom casing 106.

To the right bottom part of the casing 105, a wire shaft 120 is rotatably mounted. To such an end (top end in FIG. 7) as is extended through the casing 105, a sprocket 121 and a pulley 122 are fixedly mounted. To the other end, pulleys 122 and 123 are fixedly mounted. To the rear side plate of the casing 105, a lifter driving motor 125 is fixedly mounted by a bracket. The sprocket fixedly mounted on the output shaft thereof is operatively connected with the sprocket 121 by a chain.

As will be described hereinafter, one ends of two wires 129 and 130 are engaged and wrapped around the pulley 122. To the upper parts of the front and rear sides of the lifter plate 110 (111), pairs of guide pulley 131 and 132, are rotatably supported. One 129 of the wires extended from the pulley 122 is fixed to the wire fixing element 113 through guide pulleys 131 and 132, and the other wire 130 is fixed to the wire fixing element 111 through the guide pulley 131.

The fixing method for the wires 129 and 130 is, as shown in FIG. 8, such that ends of the wires 129 and 130 are wrapped around the bottom sides of the wire fixing element 113 and 115, and are fixed by screws at the opposite sides, by which the vertical stroke of the lifter plate 110 (111) becomes maximum. Theoretically, the lifter 110 (111) can be vertically moved through a distance h (FIG. 8), if the slit 119 is properly expanded.

The lowering wire 133 wrapped around the pulley 123 and fixed thereto at its end is fixed, at the other end thereof, to the center of the backside of the bottom casing 106 through a guide bush ring 135. The wrapping direction of the wires 129 and 130 and the wrapping direction of the lowering wire 133 are opposite around the associated pulleys. By the rotation of the wire shaft 120 in the opposite directions, the lifter 110 (111) is vertically movable.

The similar wires 129 and 130 and guide pulleys 131 and 132 are mounted on the rear side plate of the bottom casing 106, and the other ends of the wires 129 and 130 are wrapped around the pulley 122 and fixed thereto.

Thus, the lifter 110 (111) is lifted by the four wires 129 and 130, and the center thereof is lowered by the two lowering wires 133. Therefore, the vertical stroke of the lifter 110 (111) can be made larger than in the lifter drive as disclosed in Japanese Laid-Open Patent Application No. 127934/1988 in which wire is trained in the form of "8". For this reason, a larger amount of sheets can be stacked in the same space.

To the bottom casing 106, there are mounted a friction plate 136 for preventing double feed of final sheets and a sheet absent sensor 137 for detecting presence or absence of the sheet S on the bottom of the bottom casing 106. Through a hole formed in the bottom casing 106, a guide plate 139 is extended to limit the rear part of the sheet S (lateral direction). It is adjustable in its position within a range indicated by a double head arrows 141. Through another hole formed in the bottom casing 106, a guide plate 140 is extended to limit a trailing edge of the sheet S. The guide plate 140 is adjustable in its position within a range indicated by a double head arrow 141 to accept the sheet having the middle size (B4). When the sheets S have A3 or LDR size (11"×17"), it is shifted to the position indicated by a reference numeral 143.

In FIG. 7, reference numerals 145 and 146 designate a rail and a rail guiding rollers, respectively. To the rear side of the bottom casing 106, a locking roller 147 is mounted, which will be described hereinafter in conjunction with FIG. 14. The locking roller 147 functions to lock the upper/middle decks 43 and 45 in the drawing direction. To the front side of the bottom casing 106, there is mounted a cylindrical panel extension 149 to match the front panels 60 and 61 with the main assembly 41 of the copying machine.

To the end 150 of the wire shaft 120, a wire 151 is wrapped. The end of the wire 151 is operatively coupled with a driver for the remainder displays 67 and 69 shown in FIG. 2, so that the vertical position of the lifter plate 110 (111), that is, the remainder of the sheets S is shown on the display 67 and 69.

Figure 9:
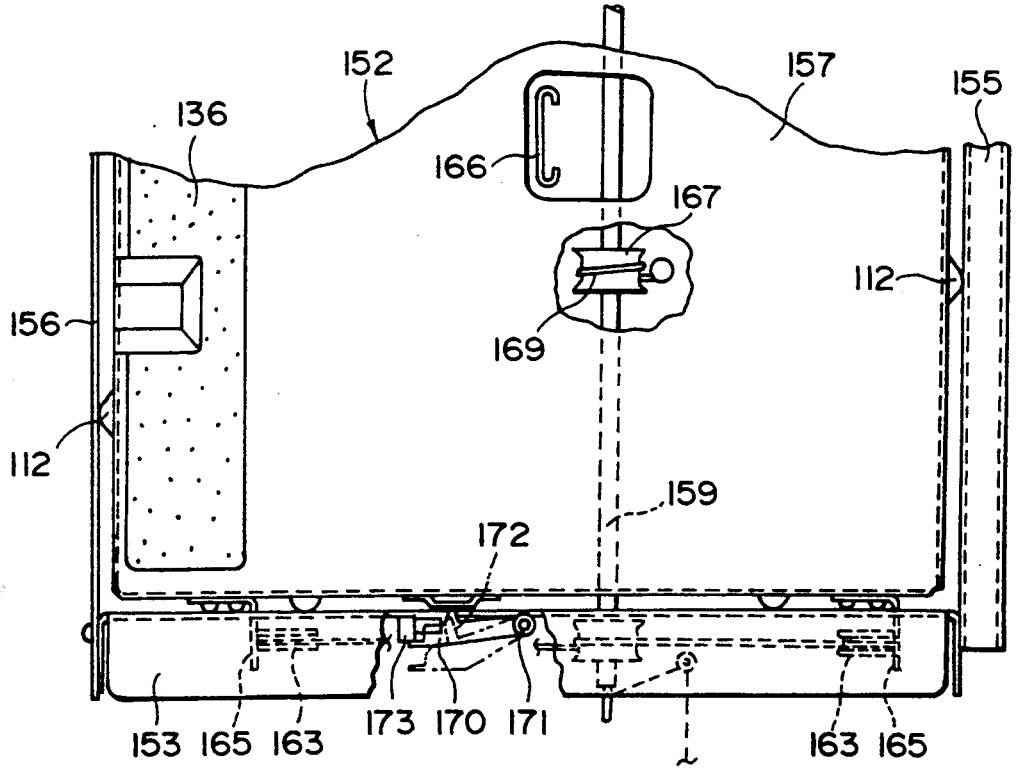
FIG. 9 is a top plan view of a lower deck.
Figure 10:
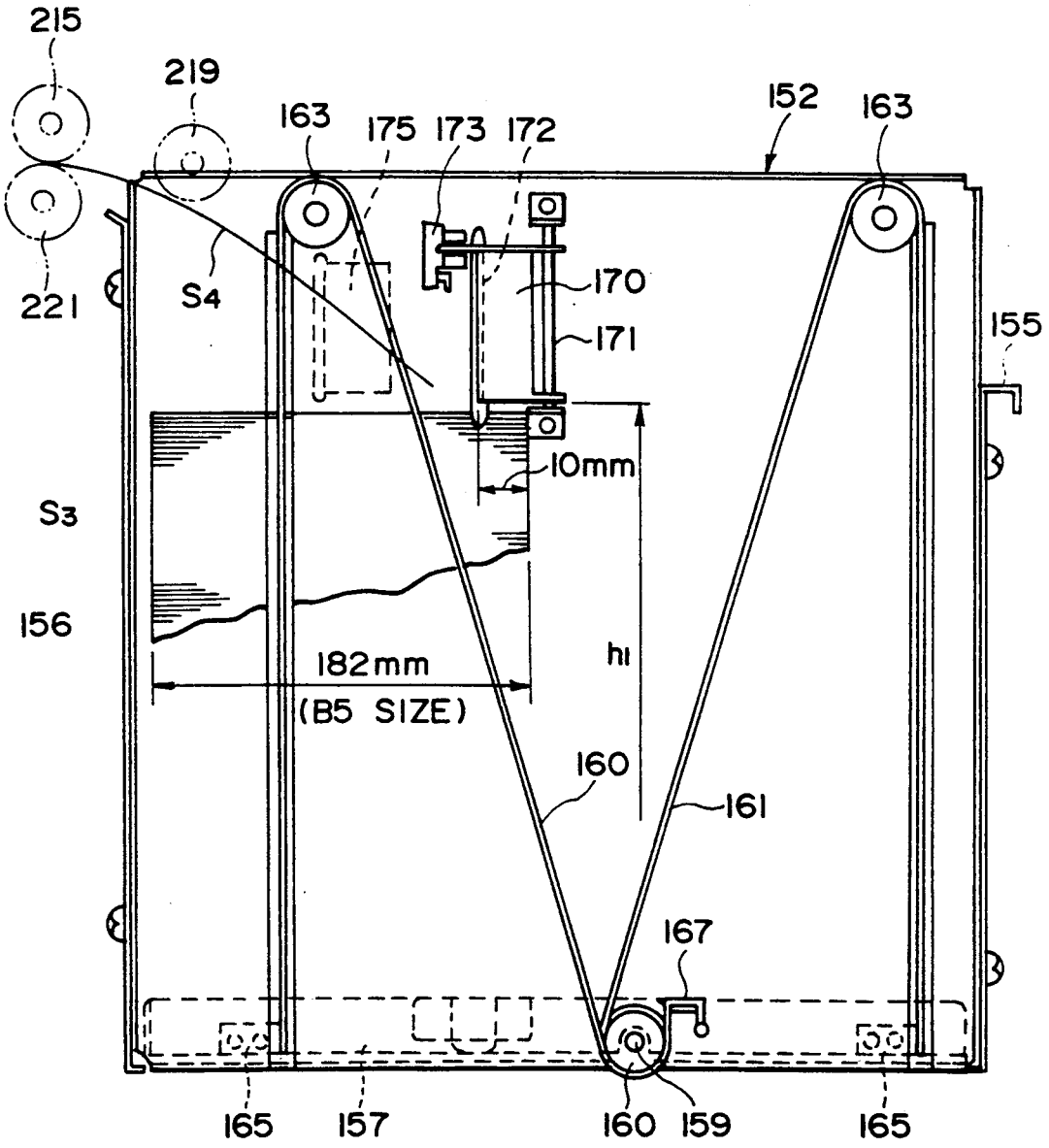
FIG. 10 is a front view thereof.

Referring to FIGS. 9 and 10, the description will be made as to the lower unit 5. The lower unit 5 fundamentally has the structure obtained b vertically expanding the upper/middle decks 43 and 45. Therefore, the description of the corresponding elements will be omitted for simplicity. A casing 152 of the lower unit 5 has a bottom casing 153, right plate 155 and a left plate 156 and the like, similarly to the upper/middle decks 110 (111).

To the bottom center of the bottom casing 153, a wire shaft 159 is rotatably mounted. To the opposite ends thereof, lifting pulleys 106 similar to the pulleys 122 are fixedly mounted. The two wires 161 and 162 having end portions fixed to the pulley 160 are trained around the guide pulleys 163 rotatably supported on the upper portion of the bottom casing 153 and are fixed to respective wire fixing element 165 which are fixedly mounted on the lower lifter 157. The same supporting structure is provided at the rear side of the lower lifter 157.

A wire 169 is trained around a lowering pulley 167 fixedly mounted to the middle of the wire shaft 159, and the other end thereof is fixed to the lower lifter 157. Through a hole formed in the lower lifter 157, a guide member 166 is extended to limit the trailing edge of the sheets S3. By an unshown wire trained around the wire shaft 159, the remainder display 70 shown in FIG. 2 is interrelatedly driven. The wire shaft 159 is rotatable in the opposite directions by an unshown motor.

The description will be made with respect to a one package sensor peculiar to the lower deck 6. In the sheet feeding apparatus of this embodiment, the manual feeding station 42, the upper/middle deck 43 and 45 (1000 sheets) and a lower deck 6 (3000 sheets) are vertically arranged in this order from the top. The reason why the 1000 sheet deck is not disposed at the bottom is as follows. If the relatively smaller capacity deck is disposed close to the floor 75, the operator is required to squat down when the sheets S are to be replenished. Therefore, the operativity is lowered.

However, if the maximum capacity deck (3000 sheets) is disposed at the bottom, the grip therefor for drawing it out can be disposed away from the floor 75, and therefore, some advantage is provided. If, however, the lower lifter 157 is lowered to the bottom position in order to permit the supply of the sheet, the operator is still required to squat.

In the sheet feeding apparatus 2 of this embodiment, a sensor is provided to the bottom deck 6 only, to permit the lowering of the top surface of the sheets S3 on the bottom lifter 157 only through a predetermined amount even when the lower deck 6 is drawn out to supply the sheets S. The sensor is used separately from the bottom limit sensor for the lower lifter 157. In this embodiment, the predetermined amount for the sheets S3 is 60 mm away downwardly from the sheet feeding position. This is because one package of upper class copy sheets usually contains 500 sheets, and the thickness of the package is approximately 50 mm.

With this structure, the sheet supply surface is always at the position away from the floor 75, and therefore, the sheet S3 can be supplied without the necessity of squatting. In addition, after the operator supplies the sheets S3 and then push the lower deck 6 and lift the lower lifter 157 to lift the topmost sheet S3 to the supply level, it is always within 60 mm, and therefore, the quick sheet replenishment is possible.

As compared with the conventional deck in which the lower lifter 157 is lowered to the bottom, the moving distance is one sixth, and therefore, the lowering period of the lower lifter 157 due to the absence of the sheet decreases, and the operativity is increased. In addition, the moving speed of the lower lifter 157 can be decreased as compared with the conventional structure, and therefore, the capacity of the lifting and lowering motor can be reduced.

Referring to FIGS. 9 and 10, a one package sensor will be described. In FIG. 10, to the front side plate of the bottom casing 153, a sensor lever 170 which is long in the vertical direction is rotatably mounted about a shaft 171 and is urged toward the sheet S3 by an unshown spring. A projection 172 formed at a free end of the sensor lever 170 penetrates through a hole of the side plate to extend toward the lower lifter 157. When the sheet S3 or the lower lifter 157 is at a level higher than the height $h_1$, the sheets S3 or the lower lifter 157 urges its to a retracted position (a position away from the side plate). To the side plate, a sensor 173 comprising a photointerruptor is fixed and is rendered on and off by the projection 172 of the sensor lever. When the topmost surface of the sheets S3 reaches the height $h_1$ or becomes lower than that by which the projection 172 is away from the sheets S3 or the lower lifter 157, the sensor lever 170 rotate toward the lower lifter 157 (inside) to actuate the photointerruptor 173.

When the lower deck 6 is drawn out for the purpose of supplying the sheets, the lifting and lowering motor can be controlled so that the height of the topmost surface of the sheets S3 is always at the level $h_1$ by the signal indicative of the actuation of the photointerruptor 173, when the lower deck 6 is drawn out for the purpose of supplying the sheets. However, if the motor lowers immediately upon the sheets being supplied, it will surprise the operator. In consideration of this, even if the topmost surface of the sheets is increased by the height of the one package of the sheets by the supply, the motor is not immediately actuated, but it is operated with the delay of 1–3 sec.

More particularly, it is only after the sensor lever 170 continues to be pressed down by the sheets S3 for 1–3 sec or longer by the supply of the sheets S3 that the motor is rotated to lower the lower lifter 157 to continue to lower it until the signal of the sensor 173 changes.

By repeating this, the level of the topmost surface of the sheets S3 can be maintained at the level $h_1$ until the lower lifter 157 reaches the bottommost position. After the lower lifter 157 lowers to the bottommost position, the motor is not rotated. After this state is reached, if the sheets are supplied more, the level of the topmost sheet is higher than the level $h_1$.

The vertically long sensor lever 170 is disposed adjacent a trailing end with respect to a sheet feed direction of the sheets having the size which can be fed from the lower deck. In the lower deck 6 of the feeding apparatus of this embodiment, the minimize size is B5, and therefore, it is disposed 10 mm away from the trailing edge of a B5 size sheet. This is done, because if there is a sheet S4 having a leading edge gripped by separation rollers 215 and 221 which will be described hereinafter, the sheet S4 bears on the lower unit, when the lower lifter 157 is lowers. At this time, if the sensor lever 170 is at the position indicated by a reference numeral 175, it detects the sheet S4, and therefore, the signal of the sensor 173 does not change however the lower lifter 157 is lowered. In order to prevent such malfunction, the sensor lever 170 is disposed as rearward as possible. However, this is limited by the minimum size. For the reasons, the position of the sensor lever 170 is quite limited.

Figure 11:
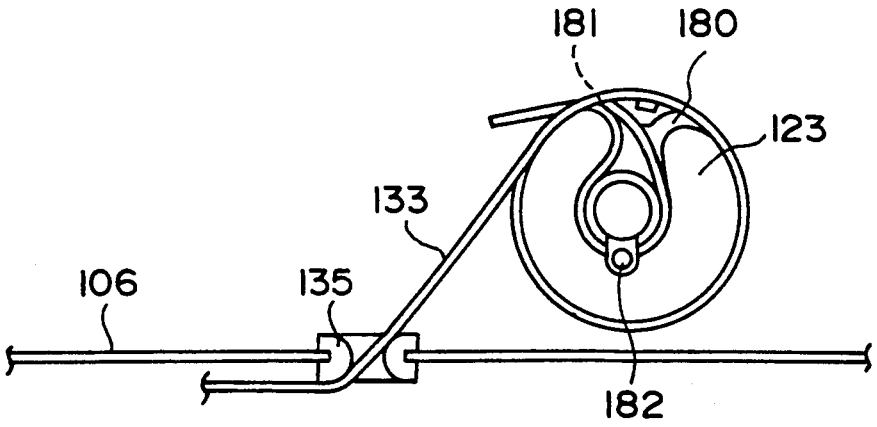
FIGS. 11, 12 and 13 show details of a wire pulley.
Figure 12:
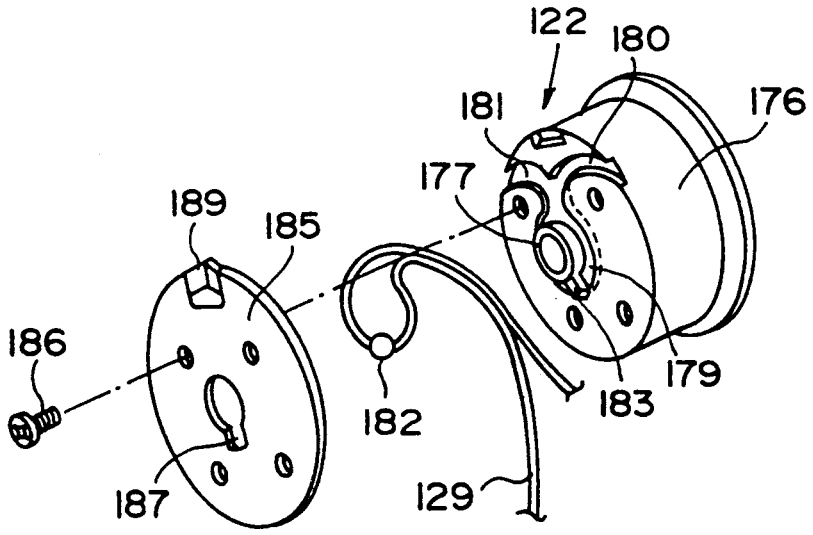
Figure 13:
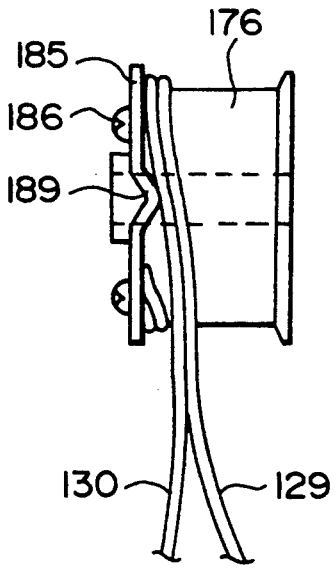

Referring to FIGS. 11, 12 and 13, the description will be made as to the pulley 122 (FIG. 7). In FIG. 12, an end surface of the pulley 176 is provided with a groove 179 formed around a boss 177 and two grooves 180 and 181 branched out of the groove 179. Each of the grooves 180 and 181 has depth l which is substantially the same as the diameter of the wire. The groove 180 is used when the wire is trained in the clockwise direction, and the groove 188 is used for the reverse direction. The wires 129 and 130 are connected to an inside of the pulley 122 and constitute a length of wire, and is divided into two parts by a ball 182 having a hole and clamped on the wire.

The ball 182 is engaged and fixed in a recess 183 formed at a middle part of the groove 179 of the pulley 176. The flange 185 and the pulley 176 sandwich the wires 129 and 130, and the flange 185 is fixed by screws 186, by which the wires 129 and 130 are fixed. The flange 185 is provided with a cut-away portion 187 engageable with the ball 182. By fixing the wire portions 129 and 130 of the one length of wire, the force which is a difference between the tension forces applied to the wire portion 129 and the wire portion 130 is applied to the ball 182. Therefore, the wire end can be more stably fixed than when it is fixed simply by clamping an end thereof. In addition, the wires 129 and 130 are free from a significant bending, and therefore, the wires 129 and 130 can be stably trained.

The flange 185 is provided with a position 189 extending toward the main body 176 of the pulley. The projection 189, when the wires 129 and 130 are trained one turn, is effective to prevent double training on the previously trained wires 129 and 130. FIG. 13 shows the prevention of the double training. The height of the projection 189 is approximately 1.5 times the diameter of the wires 129 and 130.

Figure 14:
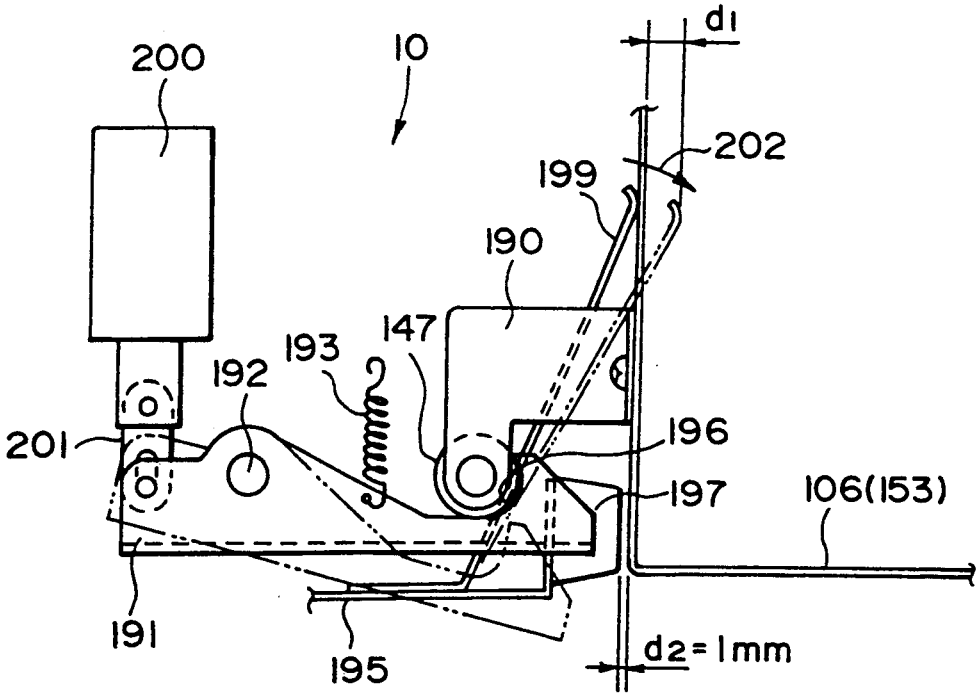
FIG. 14 is a top plan view of a locking unit for the upper/middle/lower deck.

FIG. 14 shows a locking unit for locking the upper/-middle and lower decks 43, 45 and 5, and such locking units are provided for the respective decks.

In this Figure, the rear side plate of the bottom casing 106 of each of the decks, is provided with a bracket 190 fixedly mounted thereto. It supports the locking roller 147 (FIG. 7). To the frame 3A of the upper unit 3, a supporting member 195 is fixedly mounted. The supporting member 194 has a locking pawl 191 rotatably mounted thereto by a shaft 192. By a resilient force of a tension spring 193 having an end engaged to the frame **3*a*, it is urged in the counterclockwise direction. The pawl 196 of the locking pawl 191 is formed into a circular form about a center coincident with the shaft 192. The pawl 196, when the upper and lower decks 43 and 45 are pushed and set, is brought into engagement with the locking roller 147 to prohibit the upper and middle decks 43 and 45** from being drawn out.

The supporting member 195 of the frame **3*a* is provided with a stopper 197 made of rubber mounted thereto. It functions as a stopper when the upper/middle deck 43, 45 is pushed. To the supporting member 195, a base of a leaf spring 199 is fixedly mounted. The leaf spring 199 functions to push the upper/middle deck 43 or 45 back toward the front. By doing so, the locking roller 147 and the pawl 196 of the locking pawl 191 are always in contact to correctly position the upper and middle decks 43 and 45** in the drawing-out direction.

The solenoid 200 fixed on the frame **3*a* is connected with a trailing side end of the locking pawl 191 through a lever 201. When the solenoid 200 is actuated, the locking pawl 191 is rotated to the position indicated by chain lines, and the leaf spring 199 displaces in the direction of arrow 202 through a distance d1. To retract slightly the upper/middle deck 43, 45, by which the locking by the locking pawl 191 is released. The solenoid 200 is deenergized upon a deck drawing sensor (not shown) detects the retraction of the upper/middle deck 43, 45**.

The locking unit 10 is constituted by the locking pawl 191, the locking roller 147 and the solenoid 200 and the light. The bottom deck 6 is locked by a locking unit 10 having a structure that for the upper/middle deck 43, 45.

The locking unit 10 described in the foregoing is fixedly mounted on the frame 3A, 5A by screws. However, it is adjustable in the direction of the drawing-out of the upper/middle or lower deck 43, 45 or 6. Therefore, the lateral registration adjustment is possible for the sheets S. The stopper 197 and the leaf spring 199 are movable together with the shaft 192, and therefore, the distance d1 described above and the distance d2 between the stopper 197 and the side plate of the bottom casing 106 (153) are maintained constant. In this embodiment, the distance d2 is 1 mm.

The locking unit 10 has an unshown sensor switch to detect whether the upper/middle deck 43, 45 or 6 is drawn out or locked.

Therefore, the prevention of simultaneously drawing-out of the upper/middle deck 43, 45 and 6, is electrically carried out. More particularly, any one of the upper, middle decks 43, 45 and 6 is drawn out, the other deck can not be drawn out even if the switch 71 (FIG. 2) is depressed.

Figure 15:
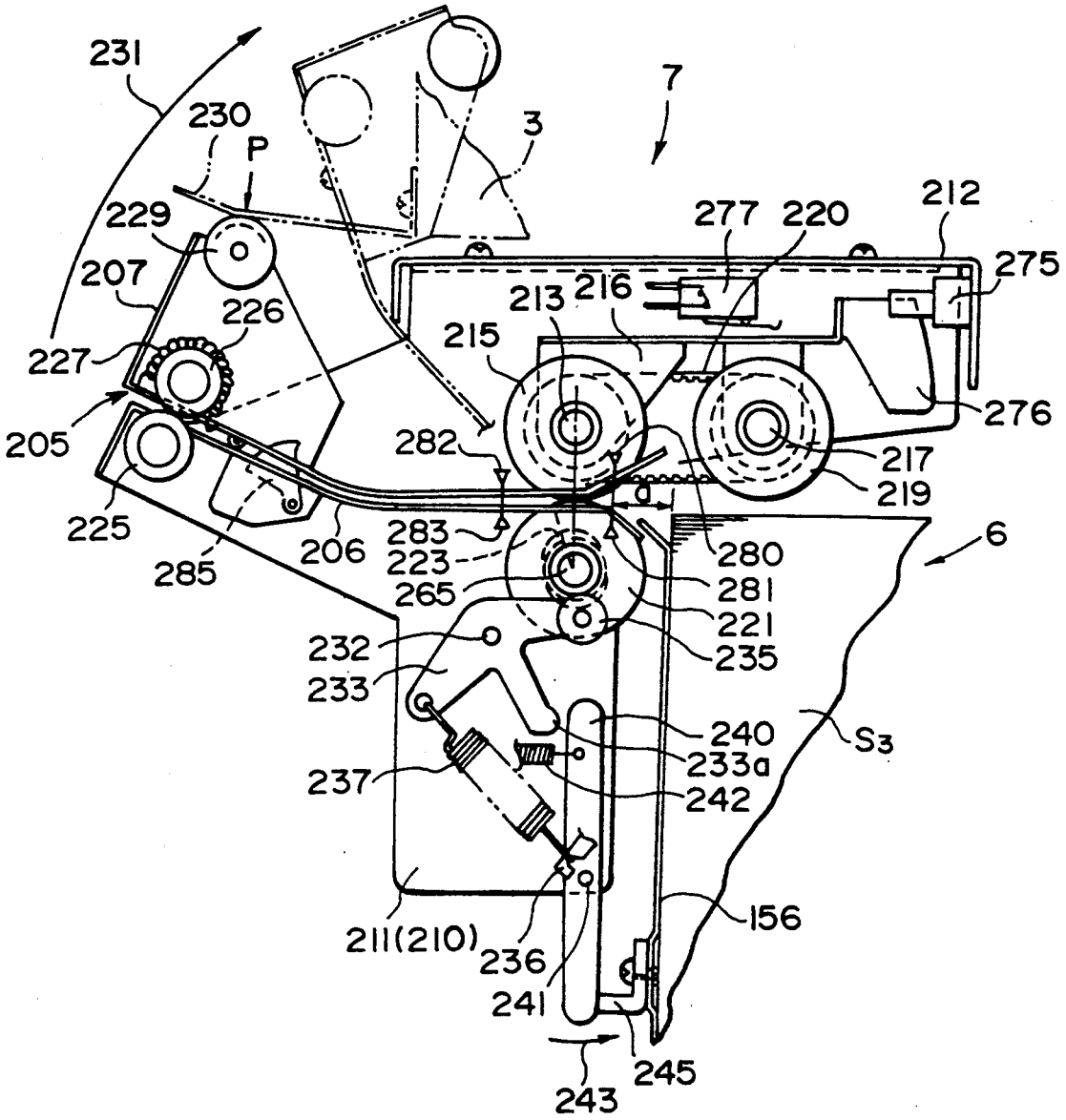
FIG. 15 is a longitudinal sectional view of a lower sheet feeding unit.
Figure 16:
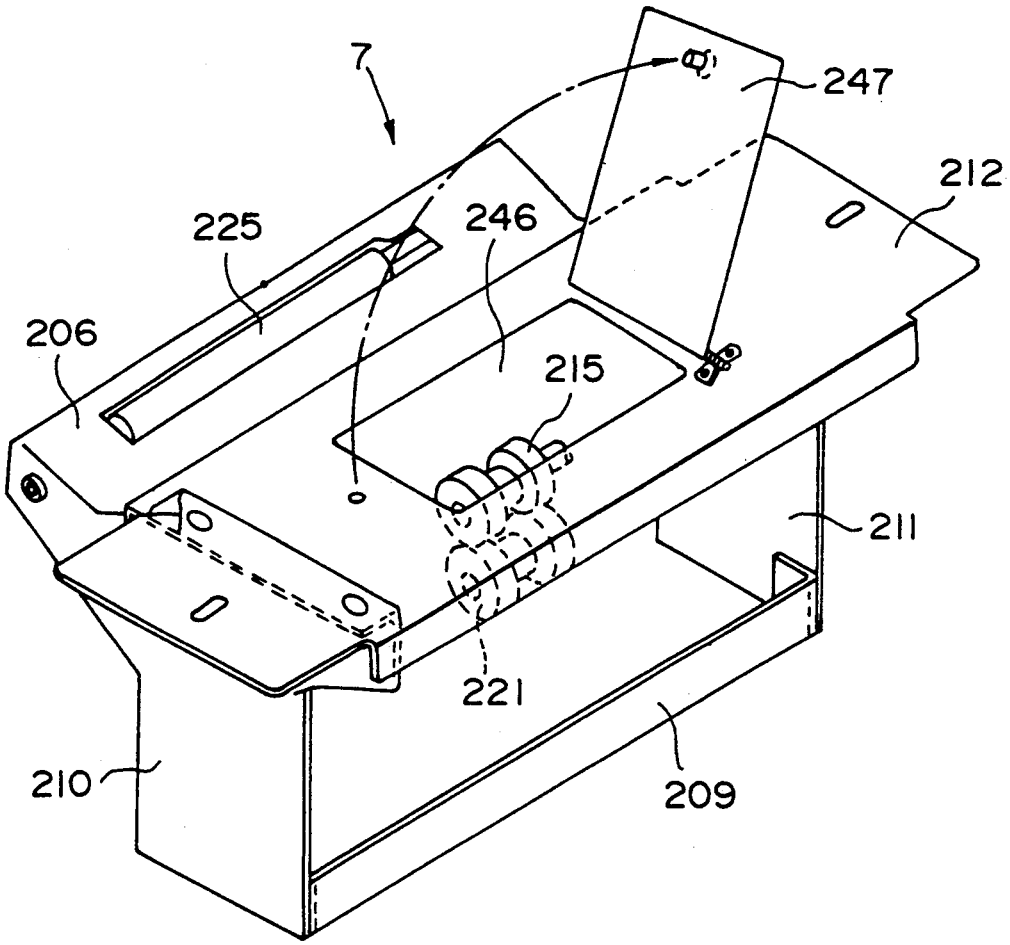
FIG. 16 is a perspective view thereof.

Referring to FIGS. 15, 16, 17 and 18, the description will be made as to the lower sheet feeding unit 7. In FIGS. 15 and 16, the lower sheet feeding unit 7 has a fixed sheet guide 206 and a movable sheet guide 207 which constitute a conveyance passage 205 for the sheets S3 supplied from the lower deck 6. The fixed sheet guide 206 is fixed to the upper portions of the frames 210 and 211 which are connected at the bottoms by a connecting plate 209. The movable guide 207 is rotatably mounted at its base portion around a shaft 213 mounted on the base 212.

To the shaft 213, a feed roller 215 is mounted through an unshown one way clutch. To the pick-up arm 216 rotatably mounted at its base portion on the shaft 213, a shaft 217 is rotatably mounted. To the shaft 217, a pick-up roller 219 is mounted through an unshown one way clutch. The pulleys fixedly mounted on the respective shafts 213 and 217 are operatively coupled by a belt 220. The lower sheet feeding unit 7 has an addicted motor (not shown). The shaft 213 is driven by the motor through an unshown electromagnetic clutch.

Figure 18:
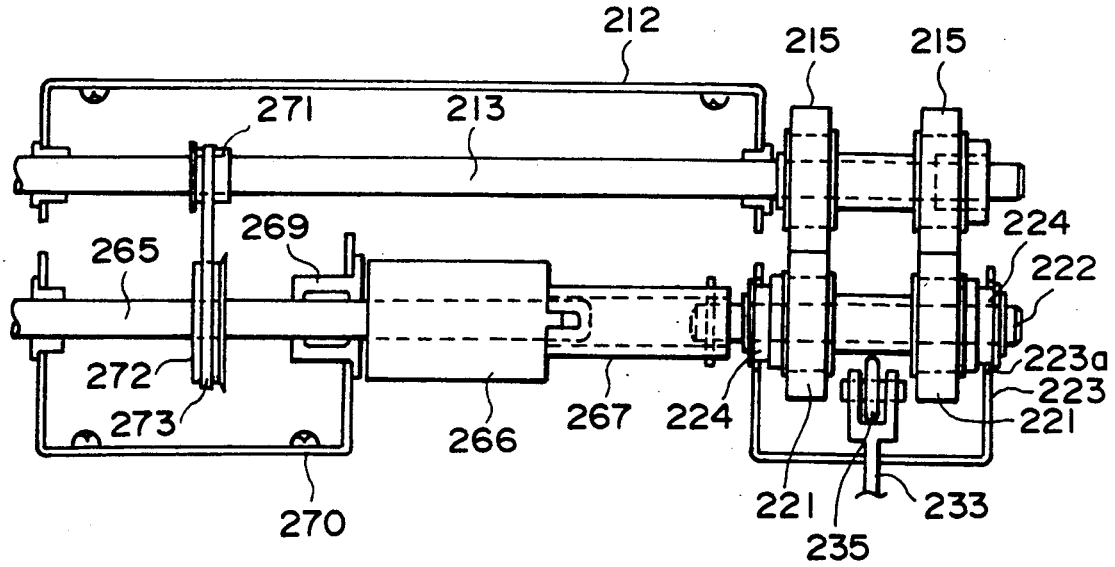
FIG. 18 is a top plan view of a retarding separator.

A retarding roller 221 contacted to the feed roller 215 functions to push back one or more of the double-fed sheets S3, and is fixedly mounted on the shaft 222 shown in FIG. 18. It is rotatably mounted on a supporting member 223 by a bearing 224. The bearing 224 is slidable in a groove 223a of the supporting member 223, and is movable toward and away from the feeding roller 215. The groove 223a, as shown in FIG. 15, is inclined at a predetermined angle (10 degrees in this embodiment) relative to a line connecting the roller 215 and the roller 221. This is done in order to increase the pressure between the feed roller 215 and the returning roller 221 when the returning roller 221 is driven, by which the sheet feeding operation is stabilized.

A roller 225 disposed downstream of the retarding roller 221 is rotatably supported on the frames 110 and 111, and is directly driven by a motor. An idle roller 226 press-contacted to the roller 225 is mounted in an elongated slot formed in the movable sheet guide 207, and is urged toward the roller 225 by a spring 227.

The movable sheet guide 207 is provided with a roller 229, and is urged in a direction P by a leaf spring 230 mounted on the upper unit 3. Upon the jam occurrence of the sheet S3, the upper unit 3 is slid in the drawing-out direction, by which the movable sheet guide 207 becomes capable of rotating in a direction indicated by an arrow 231 to the chain line position, and therefore, the movable sheet guide 207 is automatically released. This facilitates a jam clearance operation.

In FIGS. 15 and 18, a pressing arm 233 having three arms supported by the shaft 232 has an end having a rotatable roller 235. The roller 235 urges the shaft 222 by a tension spring 237 engaged with the pressing arm 233 and the engaging member 236 at the opposite ends thereof, so as to press the retarding roller 221 to the feeding roller 215.

A releasing lever 240 is rotatably mounted about a shaft 241 on the lower sheet feeding unit 7. One end thereof is urged in a direction indicated by an arrow 243 by the resilient force of a tension spring 242 locked on an unshown fixed member. The releasing lever 240 is limited in its rotation by abutment of its lower end to a pressing member 245 fixedly mounted on a left side plate 156 of the lower deck 6.

The tension spring 242 has a stronger spring force than the tension spring 237. When the lower deck 6 is slid in the drawing-out direction, the releasing lever 240 rotates in the direction of an arrow 243, so as to urge and rotate an end 233a of the pressing arm 233 to release the pressure by the roller 235. The pressing arm 233, the releasing lever 240 and the like constitute a releasing mechanism 11 to release the urging by the retarding roller 221. Upon the releasing, the lower deck 6 is drawn out, and then, the pressure by the retarding roller 221 is automatically released, thus facilitating the jam clearance operation.

Although not shown in the Figure, a separate releasing lever is used corresponding to the releasing lever 240 to release the pressing arm 233 by sliding movement of the upper unit 3 in the drawing-out direction. By doing so, the jam clearance is made further easy.

The nip formed between the feeding roller 215 and the returning roller 221 is disposed in an inside opening of the frame 3a, and the retarding roller 221 is released upon the drawing-out of the lower deck 6, and therefore, the sheet S3 can be taken out without damage thereto. In FIG. 16, the lower sheet feeding unit is detachably mounted on the lower unit 5 by a base 212. The feed roller 215 is a consumable material, and therefore, is required to be replaced with a fresh one at regular intervals. Therefore, easy replacement operation is desired.

The base 212 is provided with an opening 246, which is closed or opened by rotation of a cover 247. When the cover 247 is opened, the feed roller 215 is accessible for replacement. The retarding roller 221 is disposed at the lower portion of the fixed sheet guide 206, and therefore, it is not possible to replace it from the upper side. The returning roller 221 is in the form of a cartridge type unit. After the lower deck 6 is drawn out, the cartridge can be mounted or dismounted from the lower deck 6 side.

Figure 17:
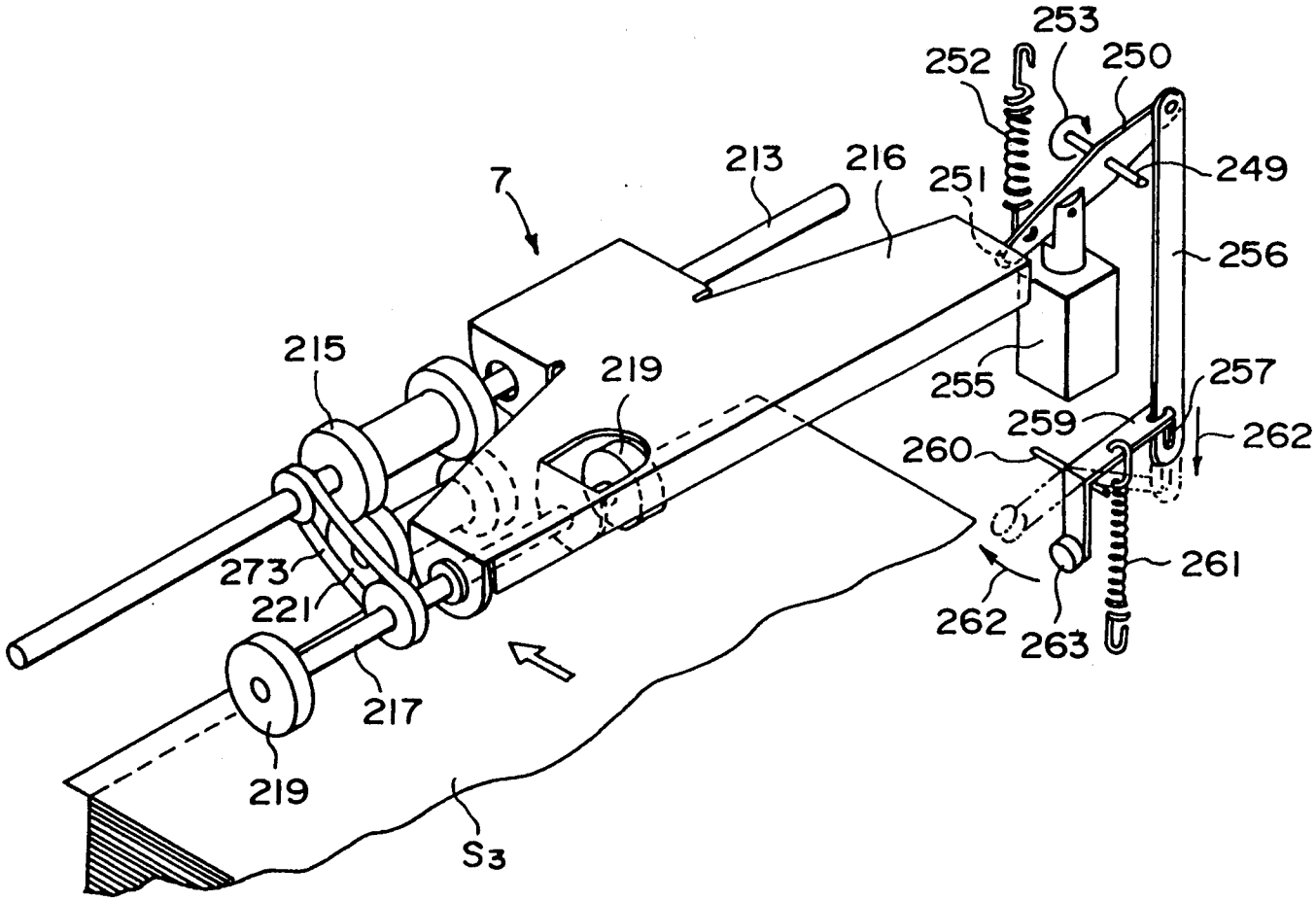
FIG. 17 is a perspective view of a pickup roller.

The pickup roller 219 is durable against 1,000,000 sheets processed. Therefore, only the roller 219 is replaceable when the lower unit 5 is entirely detached. FIG. 17 is a perspective view of the pickup roller 219, the feeding roller 215 and the retarding roller 221 of the lower sheet feeding unit 7.

The copying machine 1 of this embodiment is (capable of producing 90 copies per minutes in the mode wherein the original is fixed and read in association with the original processing device 47. However, in a mode in which one set of copies is produced from one set of originals (one-to-one), the originals are fed out from a tray exclusively for the reading scanner, and the copy is scanningly read with the optical system 51 of the main assembly 41 being fixed.

By doing so, the waste of time during the returning of the optical system 51 can be eliminated, so that the speed of the flash exposure and the copy operation can be increased. The number (90) of the sheets which can be processed per minute can be increased to 120 sheets. However, in this case, the sheet intervals become quite small despite the sheet feeding speed remaining unchanged. Therefore, the increase places quite a severe burden on the sheet feeding apparatus.

In the sheet feeding apparatus of this embodiment, the sheet interval not more than 40 mm is achieved with a sheet feeding speed of 500 mm/sec. It will be understood that the sheet interval corresponds to 0.08 sec (40/500). Then, it would not be possible to lower and lift the pickup roller 219 in consideration of the occurrence of bounding of the pickup roller 219 by abutment between the roller 219 and the sheet S3.

If, however, the pickup roller 219 is maintained in press-contact on the sheets S3 in the returning roller type, the prevention of the double feed is not enough with the result of easier occurrence of the double feed of the sheets S3. In order to solve the above problems, in this embodiment, the pickup roller 219 of the lower unit 5 is of a type in which sheet feeding pressure is changeable.

In FIG. 17, the pickup roller 219 is mounted on the shaft 217 which is mounted on the pick-up arm 216 rotatably supported on the shaft 213. An end portion 251 of the swingable arm 250 supported on the shaft 249 is disposed at a backside of an end portion of the pickup arm 216. The swingable arm 250 is urged in a direction of an arrow 253, that is, in the direction of lifting the pickup arm 216, by a spring force of a tension spring 252 having an end engaged to a fixed member. The swingable arm 250 is connected with a solenoid 255 capable of applying force in the direction opposite from that of the tension spring 252.

To the other end portion of the swingable arm 250, an upper end portion of the link 256 is rotatably mounted. With the elongated slot 257 formed in the link 256 adjacent its bottom end, an end portion of a horizontal portion of an "L"-shaped abutment member 259. An operating member 259 rotatably supported on a shaft 260 is urged in a direction of an arrow 262 by a tension spring 261. To a bottom portion of the arm extending in the longitudinal direction of the operating member 259, an abutment member 263 is fixedly mounted.

When the solenoid 255 is deenergized, the pickup arm 216 is lifted by the tension spring 252. In the case of a conventional pickup roller, the length of the tension spring 252 is as high as the pickup roller 219 is away from the sheet S3. However, in this embodiment, the strength is such that the pickup roller 219 is in contact with the sheet S3 with a contact pressure of not more than 50 g (reduced pressure) although normally it is press-contacted to the sheet S3 with the pressure of approximately 120 g.

Accordingly, the rebound of the pickup roller 219 relative to the sheet S3 is avoided, and therefore, the pickup roller 219 can repeat pressing and releasing actions substantially in response to the actions of the solenoid 255. When the solenoid 255 is energized, the pressure is approximately 120 g, and when it is deenergized, it is not more than 50 g, on the sheet S3.

When the lower deck 6 is drawn out, the link 256 and the operating member 259 and the like are effective to lift up the pickup roller 219. When the lower deck 6 is in place, the abutment member 263 of the operating member 259 is pressed by the lower deck 6, and disposed at the solid line position against the spring force of the tension spring 261. The link 256 is free within a range of an elongated slot 257.

When the lower deck 6 is pulled out, the operating member 259 is moved to the broken line position by the spring force of the tension spring 261, and therefore, the link 256 is pulled down, so that the swingable arm 250 rotates in the direction 252 to lift up the pickup roller 219.

FIG. 18 is a view of the lower sheet feeding unit 7 as seen in the feeding direction. In this Figure, to a torque limiter 266 connected with the shaft 265, a torque transmitting member 267 functioning as a universal joint is connected. To the other end portion of the torque transmitting member 267, the shaft 222 having the retarding roller 221 is connected. A shaft 265 is mounted on the supporting plate 270 through a bearing 269 with a one way clutch. The shaft 265 receives the driving force through an unshown electromagnetic clutch. By the function of the bearing 269 with the one way clutch, even if the shaft 265 is made free by the energization of the electromagnetic clutch, the retarding roller 221 rotates in the opposite direction to prevent the double feed of the sheet S3.

Figure 19:
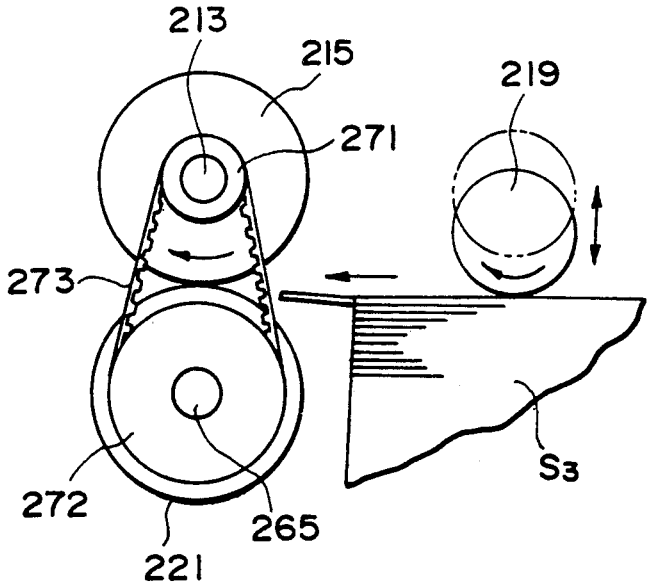
FIG. 19 is a side view thereof.

As shown in FIGS. 18 and 19, to the shaft 213 of the feeding roller 215 and to the shaft 265 connected with the retarding roller 221, pulleys 271 and 272 are respectively fixedly mounted, and the pulleys are operatively connected by the belt 273. In this embodiment, the rotational speed ratio between the pulleys 272 and 271 is approximately 1:2. The reason is as follows. If the tangential or peripheral speed of the retarding roller 221 is made equal to the peripheral speed of the feeding roller 215 and if the sheet feeding speed is increased, the maximum rotational speed of the torque limiter 266 is to large. This can be prevented by the rotational speed ratio described above. The torque limiter 266 discharges the additional torque as heat, and therefore, a high speed rotation is not desirable.

Referring to FIG. 15, sensors will be described. In this Figure, in the case 211, a sensor 275 is disposed in order to maintain a predetermined speed feeding level for the sheet S3. By a operating arm 276 fixed to a free end of the pickup arm 216, the motion of the pickup arm 216 is detected to control a lifter motor for the lower deck 6.

The switch 277 fixedly mounted in the base 212 is effective to prevent excursion of the lifter motor, when the microcomputer for controlling the sheet feeding apparatus becomes out of order. It is directly connected with a motor driving line for the lower deck 6. It is in the form of a so-called overrun switch to shut off the power supply to the lifter motor when the lower deck is lifted too much by the lifter motor.

Upstream and downstream of the nip formed by the feeding roller 215 and the retarding roller 221, transparent type sensors 280, 281, 282 and 283 are disposed, comprising light emitting portions and light receiving portions. In this embodiment, it is placed 10 mm upstream and 20 mm downstream of the nip. The reason why the sensor is of a transparent type, is that if they are of usual lever type, the quick response upon the returning action is too low. Sensors 280 and 281 are used to control the sheet feed start position. As shown in FIG. 15, normally, there is a predetermined clearance a between the leading edge of the sheet and the nip between the rollers 215 and 221, when the sheet are stacked. In this embodiment, the distance a is approximately 25 mm.

During the sheet feed, the sheet S3 is separated by the nip, and therefore, the start position of the sheet, that is, the leading end position of the sheet S3 before it is fed, in the range of distance a (25 mm), is not known. This means that the timing of the sheet feed is deviated possibly by 25 mm at the maximum.

In the usual sheet feed with the relatively large sheet intervals, the deviation of the timing is not of significant. However, if the sheet intervals as small as 40 mm is aimed at, the deviation is quite large. More particularly, a quite large error results by 40 mm$\pm$25 mm=15–65 mm. In order to minimize the deviation, the sensors 280 and 281 are used.

Operation of the apparatus of this embodiment will be described.

When the trailing edge of the sheet S fed forward from the lower deck 6 is fed by the nips formed between the rollers 215 and 221. At the instance when it passes through the nip, the discrimination is made by the sensors 280 and 281 as to whether the leading edge of the next sheet S is within the range of a of FIG. 15 or whether it is closer to the nip. If it is closer to the nip beyond the range a, the sheet is fed at the usual timing.

When the next sheet S is in the range a, the pickup roller 219 is rotated through a small distance at the instance when the sheet passes through the nip. By this, the leading edge of the next sheet S is advanced toward the nip beyond the sensors 280 and 281. Thereafter, the sheet is fed at the usual timing. By doing so, the variation in the sheet feed timing can be made smaller than in the conventional sheet feeding system.

Sensors 282 and 283 are sensors for producing the sheet feed timing. They detect the trailing edge of the previous sheet S, and the sheet feeding signal for the next sheet S is produced. With the decrease of the distance between the nip and the sensors 282 and 283, the possible sheet intervals in the sheet feeding decreases. During the prevention of the double feed by the rollers 215 and 221, the double feed occurs slightly through the nip, and thereafter, the additional feed is moved back by the retarding roller 221. Since this can happen, it is not possible to dispose it very closely to the nip, and therefore, it is disposed approximately 20 mm downstream of the nip. Downstream of the sensors 282 and 283, there is a usual lever type sheet sensor 285.

Figure 23:
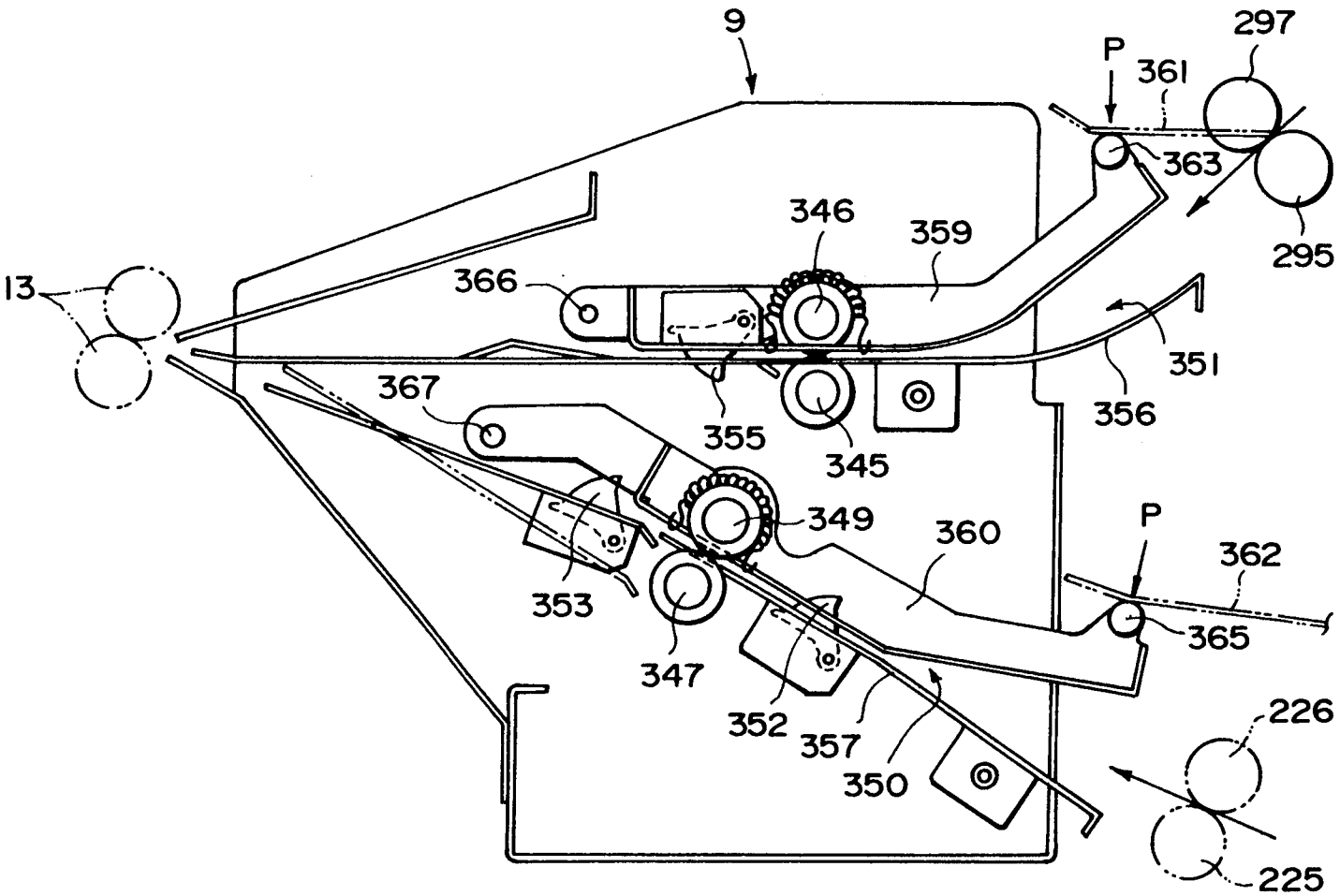
FIG. 23 is a longitudinal view of an interface unit.

Referring to FIGS. 1, 15 and 23, a pre-feed system for the sheets will be described. As shown in FIG. 1, the sheet feeding apparatus 2 of this embodiment stacks the sheets S at a position remote from the registration rollers 13 of the main assembly 41. Usually, the copy operation speed of the copying machine 1 is determined by the scanning speed of the optical system 51. Thus, downstream of the registration roller 13, the maximum copying speed can be obtained when the sheet S is fed in synchronism with the scanning speed of the optical system 51.

However, when a set of originals, the number of which is not known by the copying machine, is fed by an original document feeder 47, it is not possible to known when the original feeder becomes empty. If the sheet feeding apparatus 2 feeds the sheets with the sheet intervals so as to provide the maximum copy speed, the trouble occurs, that is, when the "no original" is detected, the next sheet has already been fed out.

Such a sheet is called "flying paper". This easily occurs when the sheet feeding station is remote from the registration rollers 13, as in this embodiment, and easily occurs when the sheet size is such that they are fed with smaller sheet intervals.

In order to solve the problem, it is conventional that the registration rollers 13 are disposed close to the sheet stacking position, or that the sheet feed from the deck is started while confirming the outstanding original for each copies, at the cost of copy speed in the mode in which it is not known when all the originals are copied. In some case, the sheet S once fed out is returned into the deck by the reverse rotation of the roller.

In this embodiment, when the sheets are fed from the lower deck 6, one flying paper sheet is deliberately remains between the lower deck 6 and the registration rollers 13, so that the above discussed problems are solved. This sheet feeding system is called pre-feed, hereinafter.

In the pre-feed system, the sheet S always remains in the sheet passage, and therefore, if the sheet S remains in a curved sheet passage, the sheet S is curled with the increased possibility of the improper image transfer operation, sheet jam and/or improper stacking of the sheets in the sorter.

In this embodiment, the sheet passage in the interface unit 9 is divided into two passages, and the sheet passage from the lower deck 6 is made substantially rectilinear (radius of curvature is not less than 100 mm). By doing so, the curling of the sheet S pre-fed is prevented. Since it is difficult to use the substantially rectilinear passage for the upper or middle deck 43 or 45, the pre-feed system is not used in this embodiment. Therefore, the copy speed is lower than that of the lower deck 6.

Another reason for not using the pre-feed in the upper and lower decks 43 and 45, is that when the upper unit 3 is drawn out, the pre-fed sheet S is divided in the sheet passages, and therefore, the sheet is no longer usable, that is, the sheet S is wasted. On the contrary, in the passage for the lower deck, the sheet S is not divided.

In the sheet feeding apparatus 2 of this embodiment, the sizes of the sheets capable of being fed out from the lower deck 6 are A4, B5 and LTR (11"×8.5"). There are some points to be considered in the pre-feeding system. One of them is that the sheet passage is substantially rectilinear a described hereinbefore. Second, the trailing edge of the sheet S pre-fed is downstream of the nip between the rollers 215 and 221.

If, when the operator is going to draw the lower deck 6 out, the trailing edge of the sheet S pre-fed remains in the lower deck 6, it obstructs the movement of the lower deck 6. In the worst case, the trailing edge portion of the pre-fed sheet is damaged or torn.

In this embodiment, the distance b from the registration rollers 13 to the lower deck 6 is determined in the following manner. In the case of A4, B5 or LTR size, it is not possible to reduce the distance b to such an extent as not to reduce the copy speed, and therefore, the pre-feeding is carried out. In the case of B4 size, the sheet intervals are larger than in the above three cases, and therefore, it is possible to set such a distance b that the copy speed is not reduced even if the sheets are fed after it is confirmed that the originals are outstanding, that is, after the sheet feed signal is received from the main assembly 41.

In this embodiment, the distance b is determined in this manner, and therefore, the pre-feeding is not used for the size B4. In FIG. 1, the position of the leading edge of the sheet S upon the pre-feeding operation is indicated by a reference numeral 286, and the size of the sheet in this case is A4.

Figure 20:
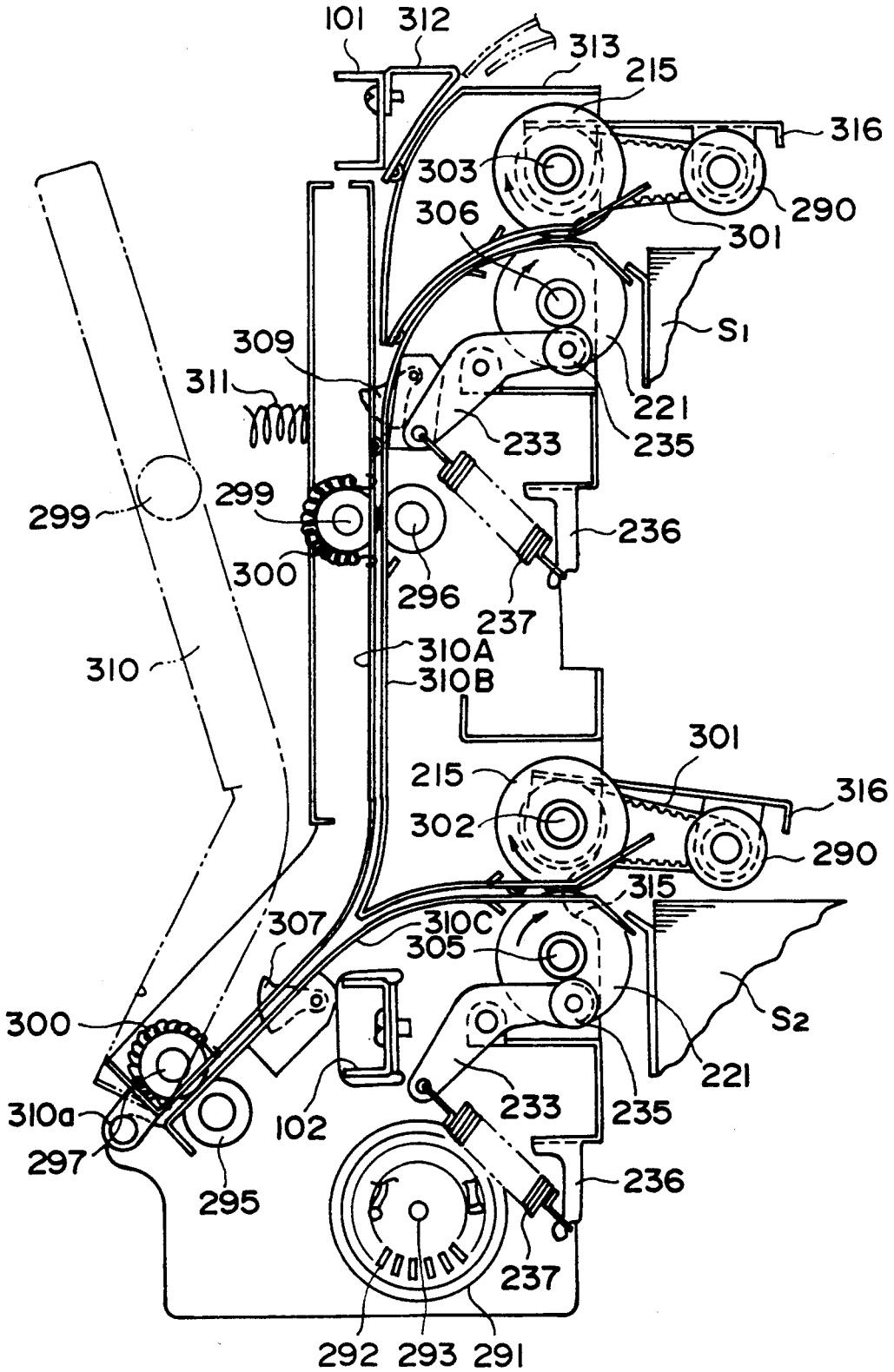
FIG. 20 is a longitudinal sectional view of an upper sheet feeding unit.

Referring to FIGS. 19 and 20, the description will be made as to the upper sheet feeding unit 56. FIG. 19 shows the relationship between the driving belt 273 for the feeding roller 215 and the retarding roller 221, a small pulley 271, a large pulley 272 or the like, which are commonly used in the lower sheet feeding unit 7 and an upper sheet feeding unit 56. In the upper sheet feeding unit 56, similarly to the lower sheet feeding unit 7, the peripheral speed of the retarding roller 221 is smaller than that of the feeding roller 215.

FIG. 20 is a longitudinal sectional view of the upper sheet feeding unit 56. In this embodiment, the upper sheet feeding unit 56 does not effect the pre-feed operation firstly because the sheet passage is not rectilinear and secondary because the pre-fed sheet becomes nonusable if the upper unit 3 is slid. Therefore, for smaller sheet sizes, it is possible that the copy speed becomes lower than the maximum copying speed of the main assembly 41 of the copying machine 1.

In order to minimize the reduction of the copy speed, the upper sheet feeding unit 56 uses a speed changeable sheet feeding system. If the sheet feed is started after the signal indicative of the existence of the outstanding original is received, the copy speed is reduced in the conventional system wherein the process speed of the main assembly is equal to the sheet feeding speed. In such a case, the sheet feeding speed is made larger than the process speed of the main assembly 41, by which the sheet is fed to the registration roller 13 quickly, so that the reduction of the copy speed is minimized. In this embodiment, such a sheet feed speed is 760 mm/sec, the process speed being 500 mm/sec.

However, it has been found that additional problems arise which are not involves in the conventional system wherein the process speed is equal to the sheet feeding speed. First, since the sheet feeding speed is so high that the slippage easily occurs if the pickup roller 290 is abruptly driven by an electromagnetic clutch (not shown). Second, as described in the foregoing with respect to the lower sheet feeding unit 7, the torque limiter 266 (FIG. 18) for driving the retarding roller 221 exceeds the tolerable rotational speed by the high speed sheet feeding. Third, since the sheet feed speed is different from the process speed of the main assembly 41, the sheet S fed out possibly abuts the trailing edge of the previous sheet S.

The sequences of the operations in this embodiment are so designed to avoid the three problems. First, the description will be made as to the structure of the upper sheet feeding unit 56.

In FIG. 20, reference numeral 291 designates a motor exclusively for driving rollers of the upper sheet feeding unit 56; 292 designates a clock plate fixedly mounted on a motor shaft 293 of the motor 291 to detect the rotational speed of the motor shaft 293.

Rollers 295 and 296 are directly driven by the motor shaft 293 by unshown belts. However, one way clutch (not shown) is used to made them free when the sheet S is drawn out in the conveyance direction. Rollers 297 and 299 are idler rollers and are pressed to the rollers 295 and 296 respectively by a spring 300 similarly to the roller 227 of FIG. 15. The upper and middle feed rollers 215, and retarding rollers 221 and rollers 235 or the like, are similar to those described in conjunction with the lower sheet feeding unit 7 (FIG. 15), the detailed description thereof is omitted.

However, it should be noted that the pickup roller 290 has a smaller diameter than the pickup roller 219 of the lower sheet feeding unit 7. The reasons for this are that, as will be understood from FIG. 1, the space around the pickup roller 290 becomes a dead space which reduces the sheet stacking capacity, that the upper/middle deck 43 and 45 accommodate 1000 sheets, respectively while the lower deck 6 accommodate 3000 sheets, and therefore, the reduction of the durability resulting from the reduced roller diameter does not disturb the balance in consideration of the frequency of use.

A belt 301 functions to transmit the driving force from the shaft 302 to the pickup roller 290. The shaft 302 and the shaft 303 are driven through an electromagnetic clutch between them and the motor 291. The shafts 305 and 306 of the retarding roller 221 are driven by a belt 273, similarly to the case of FIG. 19. In the sheet passage, lever sensors 307 and 309 are disposed. As shown in FIG. 21, stays 101 and 102 are effective to mount the entire upper sheet feeding unit 56 to the upper unit 3, as shown in FIG. 21.

A guide 310 is rotatably supported on a pivot 310*a*, and the guide 310 is opened to the chain line position when the jam clearance is required. By the opening, the idler rollers 297 and 299 become accessible. When the guide 310 is set, it is pressed from the main assembly 41 by a spring 310 to be fixed. Guides 312 and 313 receive the sheet S from the manual sheet feeding unit 42. The sheet conveying passage is formed by guides 310A, 310B, 310C, 312 and 313.

A cut-away portion 315 of the side plate extends to the nip between the rollers 215 and 221, and is provided so that when the upper or middle deck 43 or 45 is drawn out, the sheet S having reached the nip is not damaged. A pickup arm 316 is different from that of the lower unit in that it is lifted away from the sheet S1 or S2, as in the conventional system. When the solenoid (not shown) is energized or when the upper/middle decks 43 and 45 are drawn out, the pickup arm 316 is lifted.

The sequential operations will be described which solves the three problems.

When the electromagnetic clutch is engaged while the motor 291 is being rotated at the sheet feeding speed 750 mm/sec, the slippage of the pickup roller 290 is prevented by stopping the motor 291 (speed=0) immediately before the engagement of the clutch for the purpose of rotating the pickup roller 290 and actuating the motor 291 after the clutch is engaged.

By doing so, the pickup roller 290 is accelerated by the acceleration of the motor 291 itself, and therefore, the slower acceleration than the abrupt actuation of the electromagnetic clutch can be provided, so that the slippage of the pickup roller 290 can be avoided.

When the pickup roller 290 is rotated, it is contacted to the top surface of the pickup roller 290 beforehand, by deactuating the solenoid immediately before the pickup action. When the sheet S is to be stopped, the clutch is disengaged in the conventional manner to quickly stop it. Additionally, the elimination of the high speed clutching, reduces the noise.

The description will be made as to the prevention of the torque limiter 266 from exceeding the tolerable rotational speed.

In this embodiment, each of the rollers 215 and 221 have the diameter of 32 mm, and therefore, if the peripheral or tangential speed is 760 mm/sec, the rotational speed is 454 rpm. In the conventional system, the feeding roller 215 and the retarding roller 221 are rotated in the opposite directions but at the same tangential speed. If this is done, however, the torque limiter 266 is subjected to the speed which is a sum of the rotational speeds of the rollers, and therefore, it rotates at 908 rpm at the maximum. In this embodiment, the speed of the retarding roller 221 is made one half that of the feeding roller 215, as shown in FIG. 19, by which the maximum rotational speed is reduced to 681 rpm (=(454+454)/2).

However, it is still beyond the maximum tolerable rotational speed. In consideration of this, the present embodiment is such that when the electromagnetic clutch is engaged, and the shafts 302, 305, 303 and 306 are rotated by the motor 21, the maximum speed, that is, 760 mm/sec, is given up, and the normal 500 mm/sec is used. Simultaneously with the leading edge of the sheet S being gripped by the rollers 296 and 299 or by the rollers 195 and 297, the electromagnetic clutch is disengaged, and the speed of the motor 291 is shifted up from 500 mm/sec to 760 mm/sec. By doing so, the maximum rotational speed of the torque limiter 266 can always be maintained at not more than 454 rpm.

The measure against the abutment of the sheet S to the previous sheet S is only to effect close communication with the main assembly 41 and to control the subsequent sheet S on the basis of motion of the preceding sheet by sensors arranged in the sheet passage at as finest pitch as possible. Therefore, the detailed description is omitted.

The sheet feeding apparatus 2 has two sheet passages, as described hereinbefore. Therefore, the description will be made a to a special sheet feeding mode used only upon a high speed scanning reading. As described hereinbefore, only the bottom deck 6 is usable for the high speed scan-reading. However, only when the sheets S having the same size as the lower deck 6 are contained in the middle deck 45, can the sheets be alternately fed from the middle deck 45 and from the lower deck 6. By doing so, the sheet intervals can be increased by a substantial extent and thus, the sheet feeding is further stabilized.

Figure 22:
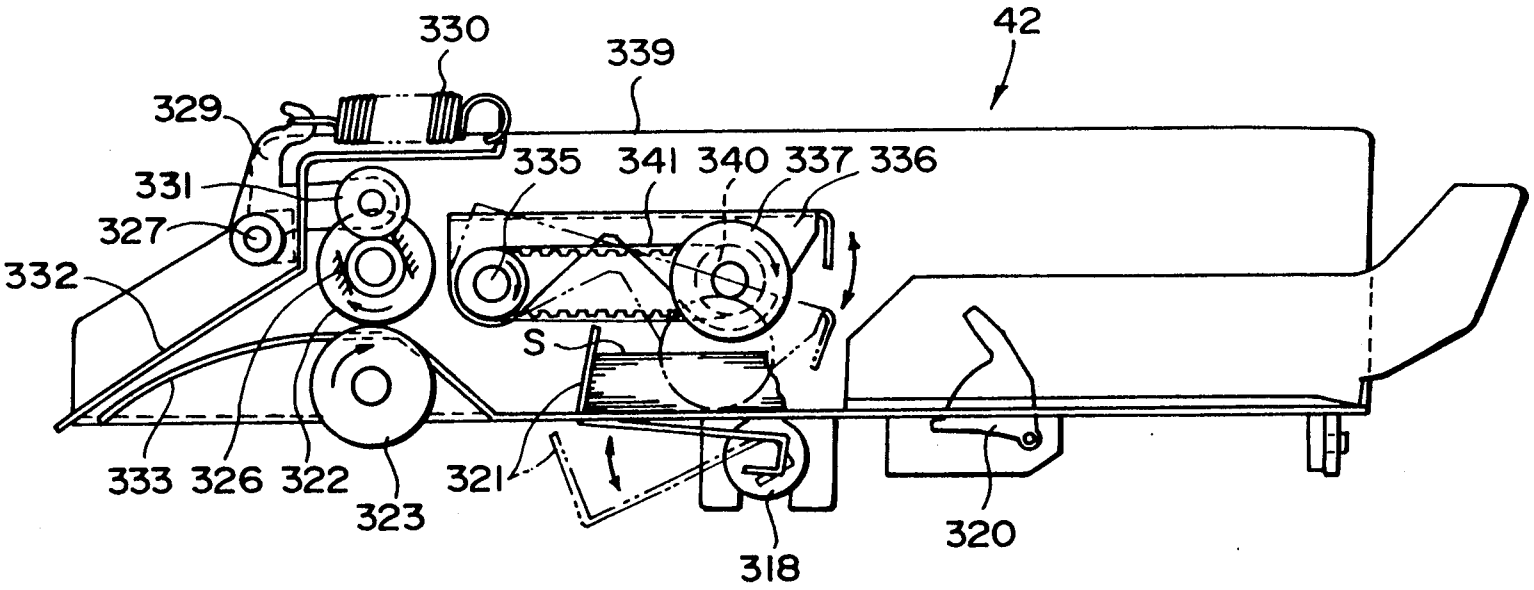
FIG. 22 is a longitudinal section view of a manual feeding unit.

FIG. 22 is a longitudinal sectional view of a manual feeding station 42. In this Figure, there are shown a sheet absence sensor 320 for detecting presence or absence of the sheet S stacked and a shutter 321 for the sheet stacking. The shutter 321 is interrelatedly moved with the transparent cover 59 shown in FIG. 2. More particularly when the cover 59 is opened to stack the sheets S, as shown in FIG. 2, the shutter 321 takes the position indicated by solid lines in FIG. 22 to prevent the operator from stacking the sheets S beyond the shutter 321. This is because the malfunction of the sheet feed can occur when the sheets S are inserted at once between the feed roller 322 and the retarding roller 323, that is, if the sheets S are inserted too much. The shutter 321 is rotatable in the direction indicated by an arrow about a shaft 318, so that when the cover 59 is closed, the shutter 321 rotates to the chain line position to permit sheet feed.

The conventional shutter for the manual sheet feed station, is directly driven by a solenoid. In order to avoid the problem that the power supply to the solenoid continues unlimitedly even if the solenoid is supplied with 100% power, the use is made with spring clutch, a cam or the like to retain selective two positions of the shutter without power supply. However, since in the embodiment, the cover 59 is provided for the manual sheet feeder 42 and since it is interrelated with the shutter 321, the cost can be reduced, and simultaneously, the introduction of foreign matter into the copying machine 1 can be prevented.

The cover 59 is provided with an unshown open-close sensor so as to prevent the sheet feeding operation unless the cover 59 is closed.

To the frame of the manual sheet feed 42, a feed roller 322 is rotatably mounted, and the retarding roller 323 press-contacted thereto is driven through a torque limiter not shown. The shaft of the feed roller 322 is slidable in a groove 326 and is driven through a universal joint not shown. The groove 326 is slightly inclined so as to increase the pressing force to the retarding roller 323 is increased when the driving force is applied, as described in conjunction with FIG. 15.

A pressing lever 329 rotatably supported on the shaft 327 is urged in the clockwise direction by a spring 330, and a pressing roller 331 rotatably supported on the lever 329 urges the shaft of the feeding roller 322. Downstream of the rollers 322 and 323, there are sheet feed guides 332 and 333 for guiding the fed sheet S.

A pickup roller 336 having an end portion rotatably mounted on the shaft 335 at its base portion, has a free end portion on which the pickup roller 337 is rotatably mounted. A pulley 339 mounted on the shaft 335 and a pulley 340 mounted on the shaft of the pickup roller 337 are operatively connected by a belt 341. Upon actuation of the solenoid, the pickup roller 337 falls by the weight thereof on the sheet S to the chain line position to be press-contacted thereto. The manual sheet feeder 42 is driven by an addicted motor (not shown), and is not provided with a clutch such as an electromagnetic clutch, and therefore, the sheet feed operation is controlled only by the rotational speed control of the motor.

As shown in FIG. 1, the top cover 57 functions also as a tray for the manual feed station. It rises with an increased arcuation toward the right side to have a maximum height at an edge of the cover 57. Therefore, the sheets S are more easily handled than when the cover 59 is flat as indicated by chain lines 342.

FIG. 23 is a detailed sectional view of the interface unit 9. When the sheet feeding apparatus 2 is attached to the main assembly 41 of the copying machine 1, the interface unit 9 replaces the cassettes. By an unshown addicted motor, rollers 345 and 347 are driven through an electromagnetic clutch. Idler rollers 346 and 349 are press-contacted to the rollers 345 and 347. A sheet feed passage 350 is provided with sheet detecting sensors 352 and 353, and the upper sheet feed passage 351 is provided with a sheet detecting sensor 355. Reference numerals 356 and 357 designate fixed guides and 359 and 360 designate movable guides releasable upon jam clearance operation. The movable guides 359 and 360 are fixed by the free end rollers 363 and 365 being pushed in a direction P by leaf springs 361 and 362 mounted on the upper unit 3.

Because of the structure of the interface unit 9 as described above, when the upper unit 3 is slid in the direction indicated by an arrow 83 (FIG. 5) upon the jam clearance operation, the guides 359 and 360 open the sheet feed passages 350 and 351 about the shafts 366 and 367, and therefore, the jam clearance operation is made easier.

The sheet 286 pre-fed (FIG. 1) is detected at its leading edge by the sensors 352 and, and after the clock is counted, it is stopped at a predetermined position. The sensor 353 is not indispensable. However, in consideration of the possibility that the microcomputer looses the stopping position due to power shut off or that the position of the pre-fed sheet is changed by the operator or the like, the sensor 353 is disposed downstream of the stop position of the leading edge of the pre-fed sheet 286 and upstream of the registration rollers 13 of the main assembly 41.

By using the two sensors 352 and 353 and by interposing the leading edge of the pre-fed sheet 286 therebetween, the pre-fed sheet 286 can be completely controlled.

Figure 24:
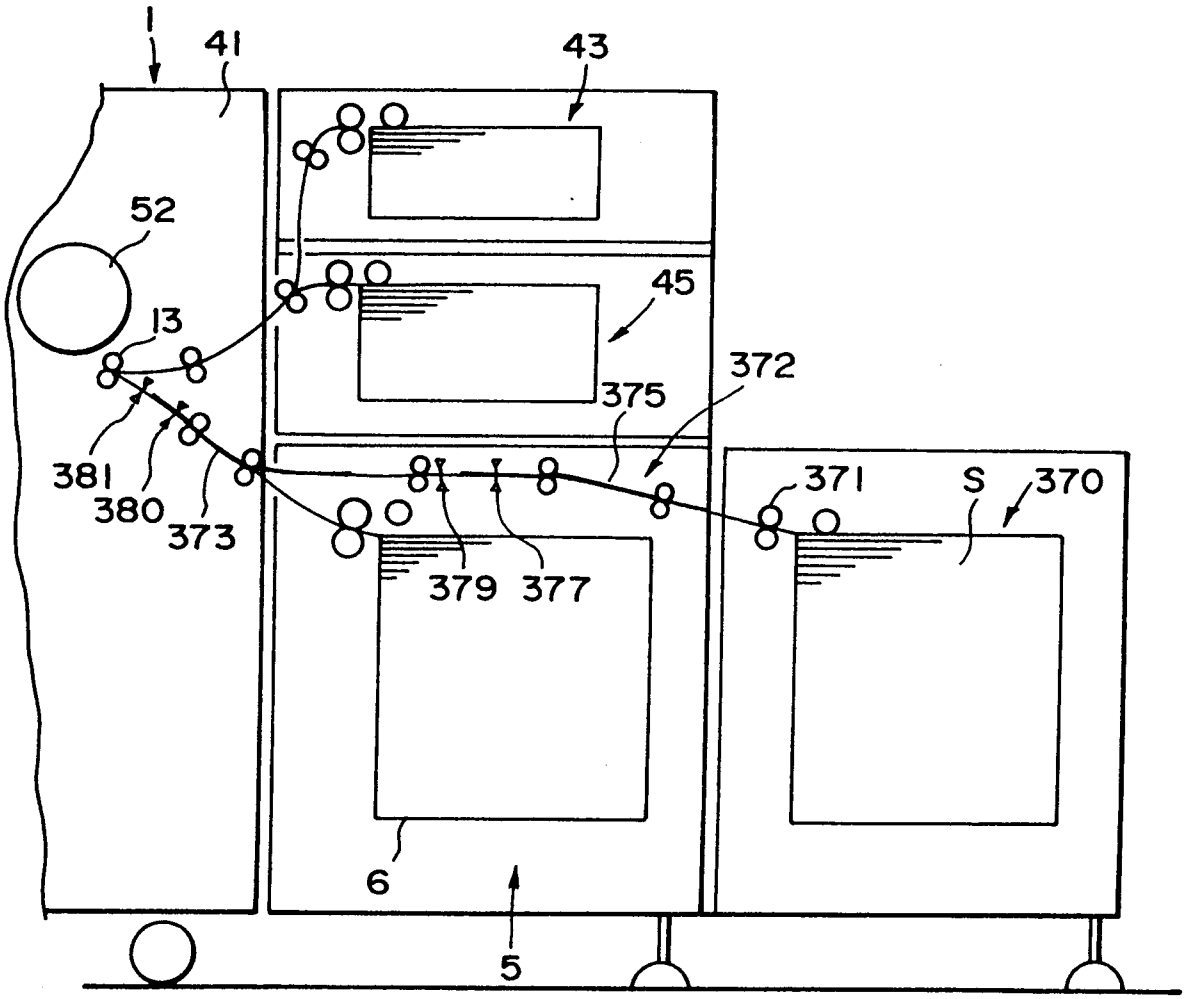
FIG. 24 shows a general arrangement of the apparatus according to a second embodiment of the present invention.

In this embodiment, only one sheet is pre-fed, but the number thereof may be two or more if the sheet passage is very long. In FIG. 24, the lower unit 5 has an additional deck 370. The distance L between the separating portion 371 of the deck 370 and the registration rollers 13 of the main assembly is very large, as measured along the sheet passage 372.

When the sheet passage 372 having a large length L, is required, the distance L is determined so as to be an integer multiplied by (length of the sheet S in the sheet conveyance direction + sheet intervals upon continuous copy operation), and the size of the sheet S is also selected to satisfy the above. Then, it is possible to pre-feed two sheets 373 and 375. In the sheet passage 372, sheet detection sensors 377, 379, 380 and 381 are disposed. As described in the foregoing, the pre-fed sheets 373 and 375 are watched.

In this case, the sheet S has a long size, the same advantageous effects can be obtained if the number of pre-fed sheets rather than the size of the sheet is reduced.

Figure 25:
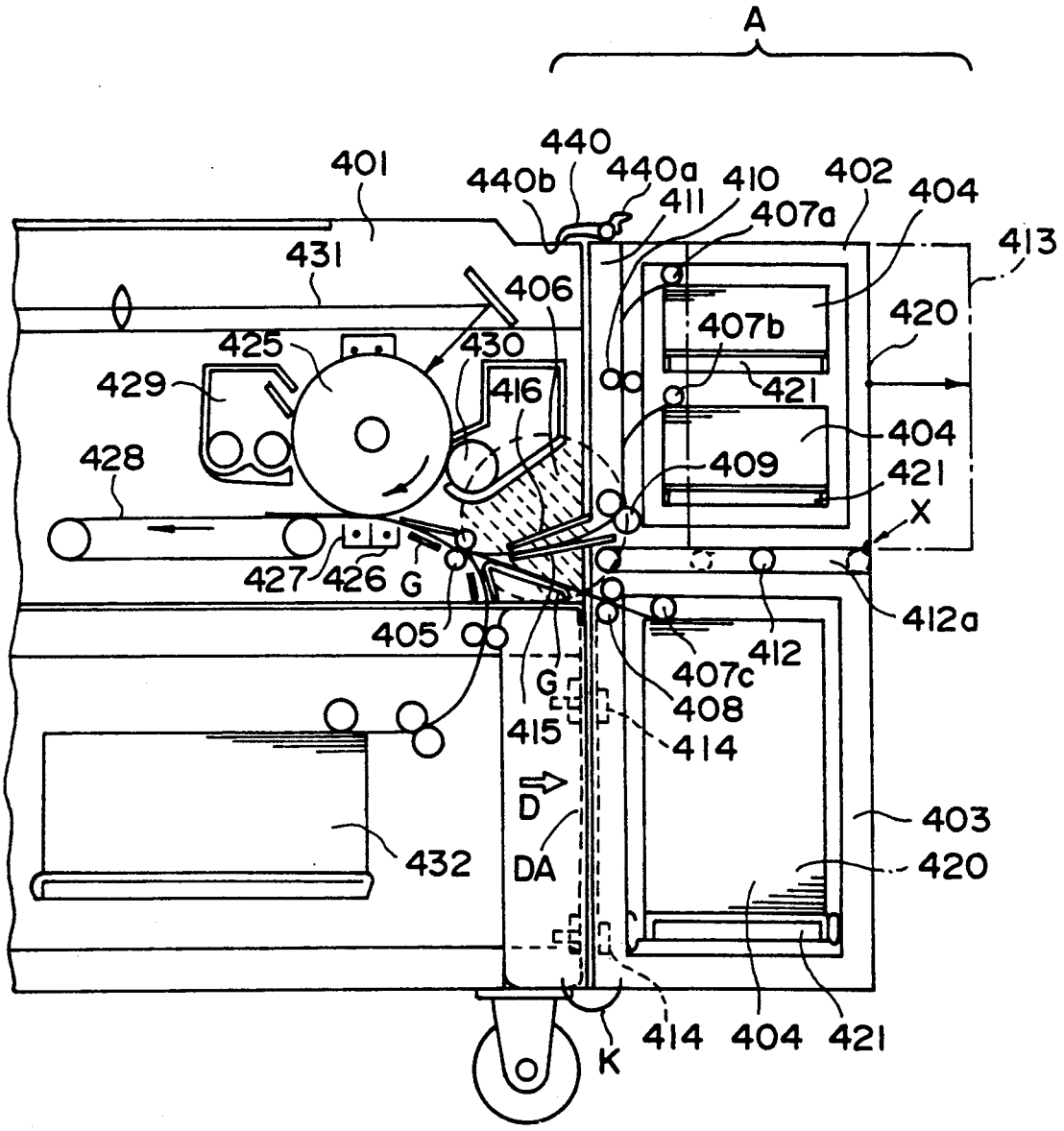
FIG. 25 is a front sectional view of a sheet feeding apparatus according to a third embodiment of the present invention.
Figure 26:
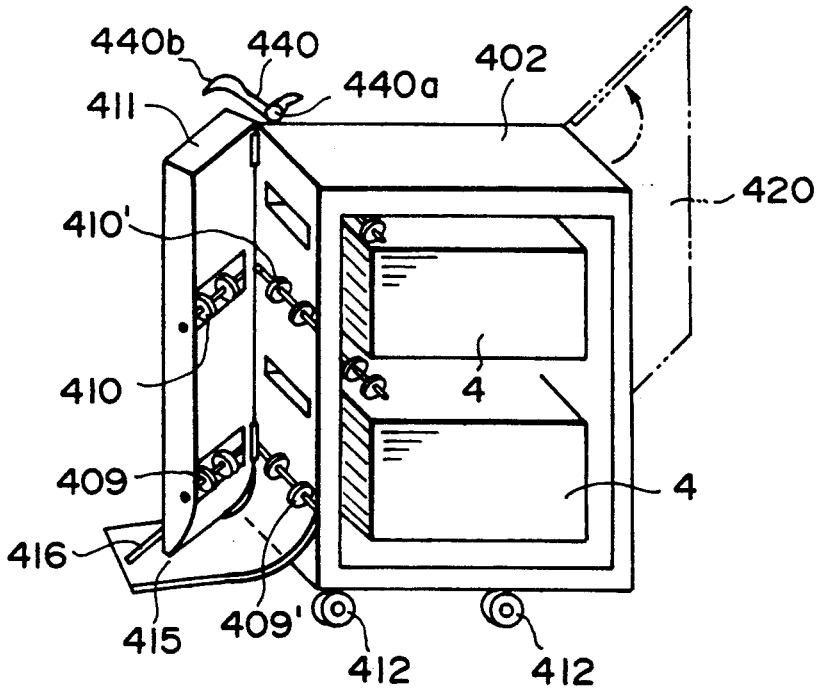
FIG. 26 is a perspective view of a unit of FIG. 25.

Referring to FIGS. 25 and 26, a sheet feeding apparatus according to a second embodiment of the present invention will be described. A main assembly 401 of the copying machine is provided with a cassette receiving base to the proper side of the main assembly when the external sheet feeding apparatus A is not mounted thereto. Then, the copying machine can be supplied with the sheet from a cassette or cassette mounted on the cassette receiving base. When a sheet feeding apparatus A is mounted, a sheet feeding guides 415 and 416 replace the cassette receiving base. The sheet feeding apparatus A comprises plural sheet feeding decks 402 and 403. Adjacent the sheet receiving portion of the main assembly 401, it is divided into an upper unit 402 and a lower unit 403. The lower sheet feeding unit 403 is fixed by bolts 414 to the main assembly or to a pedestal frame. The upper sheet feeding unit 402 is slidably mounted on the top surface of the lower sheet feeding unit 403 by rails 412*a* and rollers. Designated by a reference numeral 405 is registration rollers for receiving copy sheet 404. In an insertion port 405, usually a cassette receiving base is mounted. When the sheet feeding unit 402 or 403 is not mounted, a cassette is mounted on the cassette case, so that the sheets can be supplied from the cassette. In the sheet feeding unit, there are pick-up rollers 407*a*, 407*b* and 407*c*, sheet feeding roller pairs 408, 409 and 410. A sheet conveying passage opening door 411 is provided in the upper sheet feeding unit 402. A roller 412 of the upper sheet feeding unit rolls on the rail 412*a* mounted on the top frame of the lower sheet feeding unit 403. Therefore, the upper sheet feeding unit is easily slid with light force. The drawn-out position is determined by the stopper means, and the falling of the unit 402 is assuredly prevented by raising the unit 402 slightly, the engagement with the stopper means is released, and then, the unit 402 can be completely removed.

When the upper sheet feeding unit is slid, it takes the position indicated by the broken lines 413. What is required is to remove the jammed sheet from the space 406, and therefore, the sliding stroke of approximately 150–250 mm is enough. Designated by a reference numeral 414 is a bolt.

Sheet guides 415 and 416 function to guide the sheet from the upper sheet feeding unit 402 to the registration roller 405. It is mounted to each of the unit 402 and a door 411, and can be drawn out together with the unit 402 upon the jam clearance operation.

With the above-described structure, if the jam occurs, the upper sheet feeding unit 402 is slid to the right. At this time, the force required for the sliding motion is small firstly because the upper sheet feeding unit 402 is supported by rollers 412 and rails 412*a* and secondary because only the weight of the upper sheet feeding unit 402 is applied between the rails and the rollers. The lower sheet feeding unit 403 is fixed on the main frame, and therefore, the influence of the surface condition of the floor can be avoided, and simultaneously, the upper sheet feeding unit 402 may be jointed with the main assembly 401 with precision without influence of the floor conditions. A door 411 is provided to permit removal of the jammed sheet in the conveyance passage of the upper sheet feeding unit 402. The jammed sheet can be removed by releasing the rollers 409 and 410.

Therefore, when the sheet material is jammed adjacent to the inlet port, the jammed sheet can be removed without opening the door 411 but only by sliding the unit 402. If the sheet is jammed in the passage, the door 411 is opened for the purpose of removing the jammed sheet. When the sheet is jammed within the unit, the door 420 for the supply of the sheet materials is opened, and an intermediate plate (sheet material) 421 is lowered to permit clearance of the jammed sheet. The unit 403 is of a front loading type wherein it is drawn out toward the operator, and therefore, the door is provided at the front side.

When the unit 402 is drawn to the light, an opening is also formed at the top of the unit 403. Through the opening, the jammed sheet can be removed from the neighborhood of the sheet feed port of the unit 403.

In FIG. 25, the main assembly comprises a photosensitive drum 425, a transfer charger 426, a separation charger 427, a conveying belt 428, a cleaner 429, a developing device and an image information exposure source 431. A sheet feeding unit 432 is mounted on a pedestal or the image forming apparatus. The main assembly is provided with a guide plate G, an operating lever 440 detachably mountable to mount the unit 402 to the main assembly. An end 440*a* thereof is rotatably supported, and the other end 440*b* thereof is engaged with a hole of the main assembly of the copying apparatus. The unit 403 is electrically connected to a power source which is different from the power source of the copying machine, and the communication with the main assembly is carried out through a cable K. Also, the unit 402 and the unit 403 are connected by a cable. The unit 403 is provided with a microcomputer.

A third embodiment of the present invention will be described. In the foregoing, the lower sheet unit 403 has only one deck. However, multi-stage deck is usable if the jammed sheet can be removed from the pedestal side, for example, from the D side of FIG. 25 with a door Da to permit access to the passage. On the contrary, the upper sheet feeding unit 402 may have a single deck. In place of the sheet feeding unit 402, a cassette case permitting use of a cassette, may be used. In this case, the unit 403 is left mounted, and the unit 402 is dismounted, and the cassette receiving base is mounted in the insertion port 6.

In this embodiment, the upper sheet feeding unit 402 is slidable in the left-right direction. However, it may be slidable in the front-rear direction (the direction perpendicular to the sheet of the drawing of FIG. 25). Alternatively, it may be rotated about a pivot disposed at a rear corner (X in FIG. 25, for example).

Figure 27:
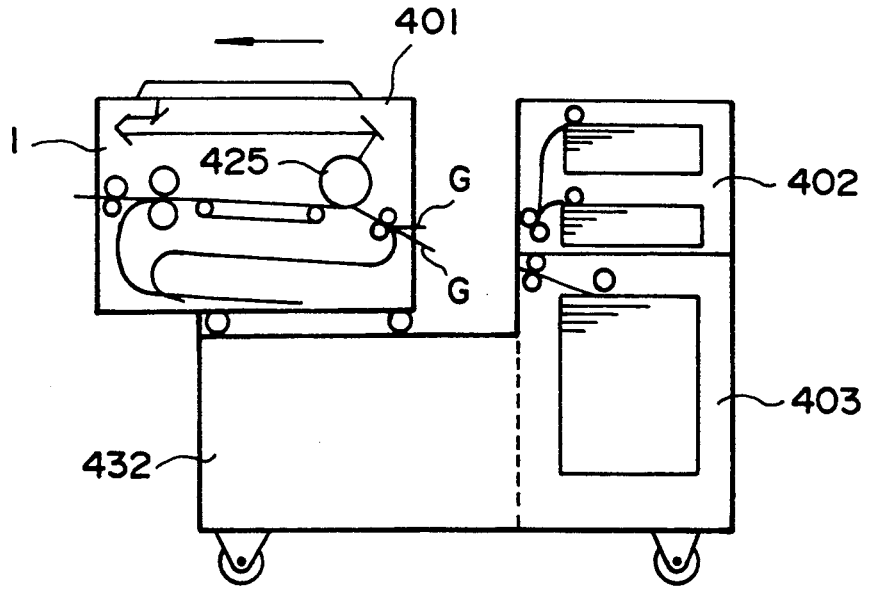
FIG. 27 is a front sectional view of a sheet feeding apparatus according to a fourth embodiment of the present invention.

FIG. 27 shows a structure usable only when the size of the copying machine is smaller than that of the sheet feeding apparatus. It is a modification because the upper unit of the multi-stage sheet feeding deck and the main assembly are relatively moved away.

As described in the foregoing, the large capacity sheet feeding apparatus externally mountable to the image forming apparatus has a multi-stage sheet feeding unit. It is divided substantially vertically into upper and lower parts with a boundary adjacent to the sheet reception port formed at a side of the main assembly. The upper sheet feeding unit and the lower sheet feeding unit are connected for sliding movement relatively. The lower sheet feeding unit is fixed to the pedestal or frame of the main assembly, so that it is movable on the floor by common casters to permit the relative movement between the sheet feeding unit and the main assembly to be away from each other. Because of this structures, even if a large capacity sheet feeding apparatus is mounted externally, the following advantages are provided.

(1) The influence of the surface conditions of the floor can be avoided, that is, the sheet feeding apparatus can be correctly positioned relative to the main assembly.

(2) The unit can be moved with small force when jam clearance operation is required, for example.

(3) Jam clearance is easily carried out.

(4) The sliding rail can be simplified with the result of low cost.

Figure 28:
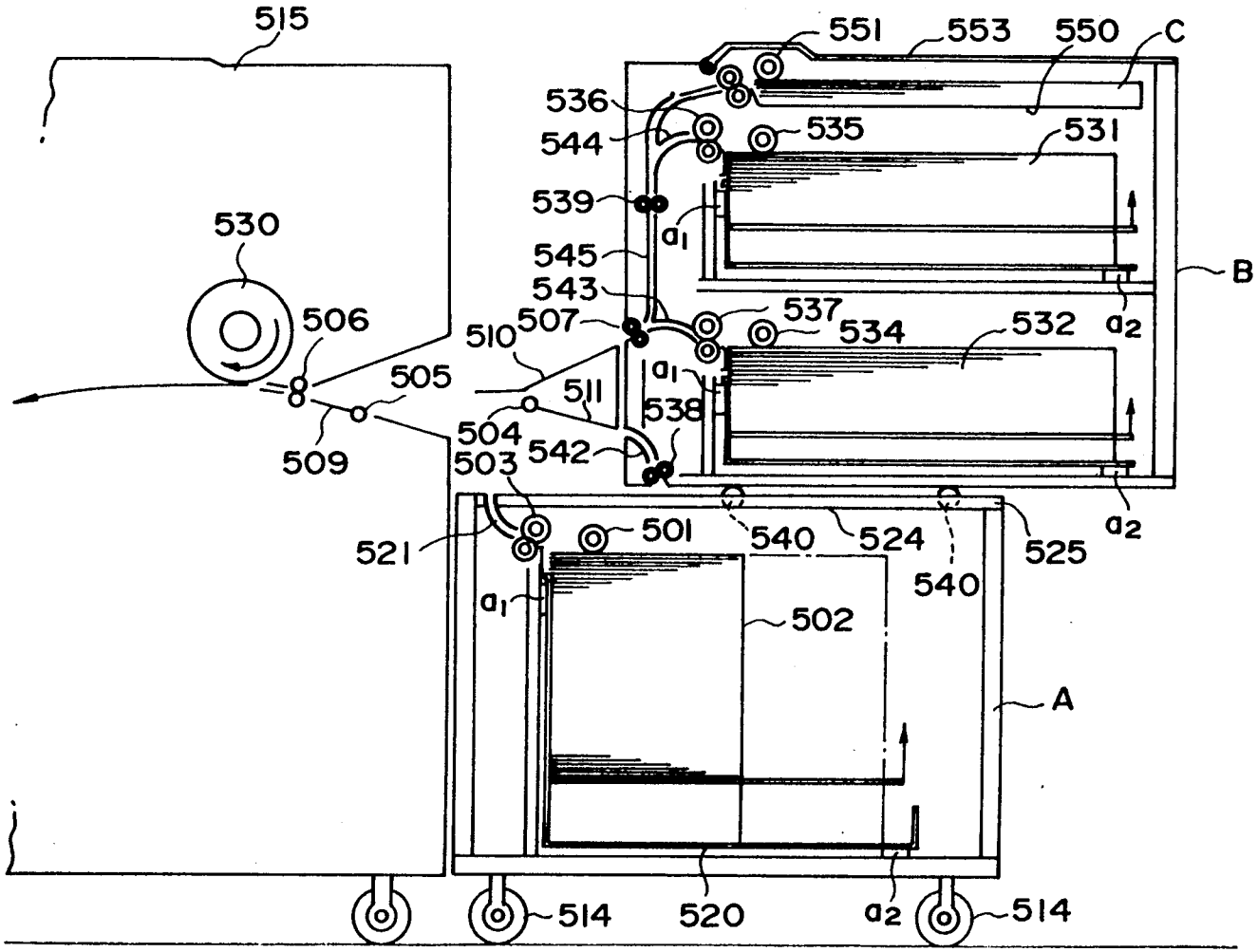
FIG. 28 is a sectional view of the apparatus of the force embodiment when the upper unit is slid for the purpose of jam clearance operation.
Figure 29:
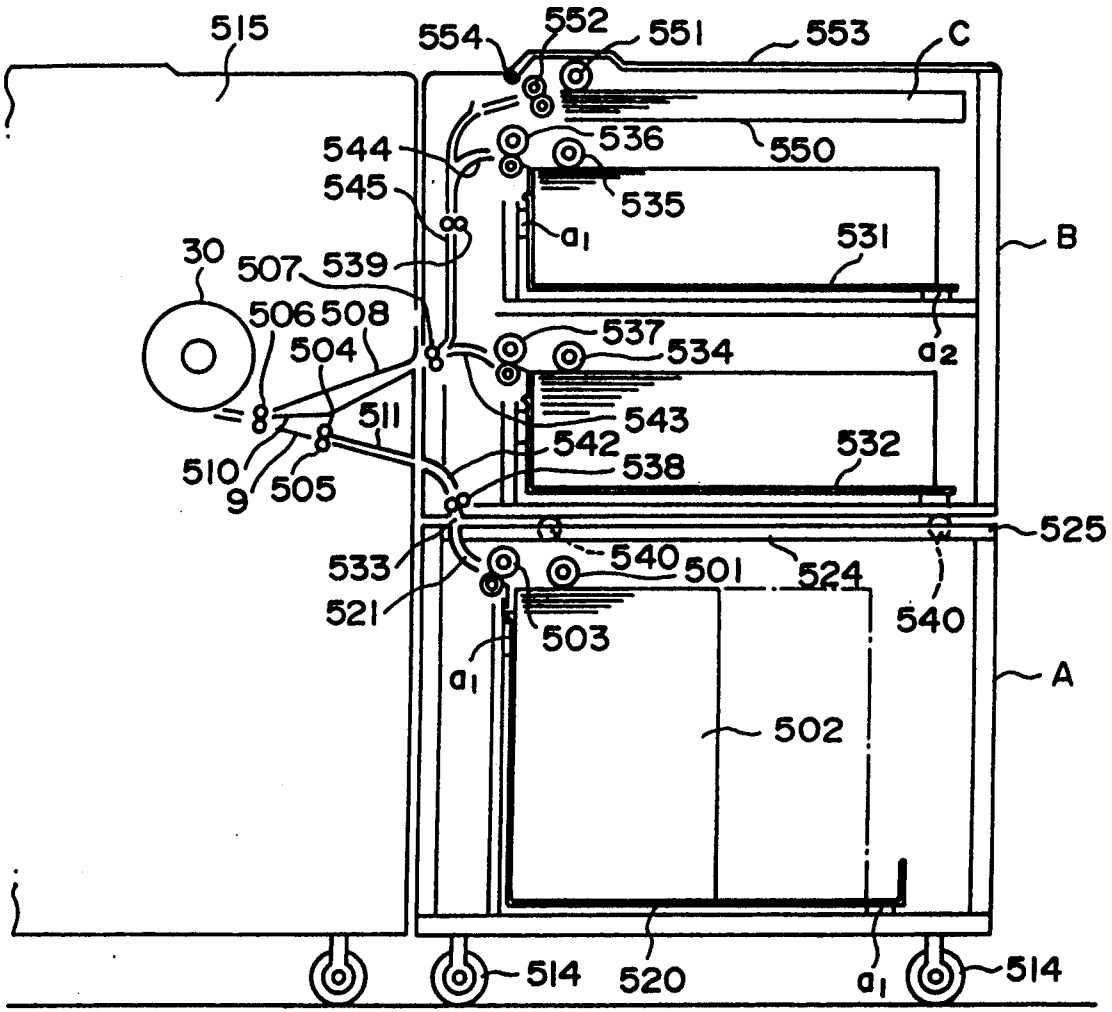
FIG. 29 is a sectional view when a large capacity sheet feeding unit is mounted to an image forming apparatus.

Referring to FIGS. 28 and 29, a fourth embodiment will be described. FIG. 28 shows for the purpose of better understanding the apparatus when the upper unit is slid for the purpose of permitting the jam clearance. In this Figure, an upper sheet feeding unit B is supported slidably on the lower sheet feeding unit A. The lower unit includes a vertically movable deck 520 to stack thereon sheet materials. A sheet passage 521 functions to guide the sheet material to a bottom opening 533 of the upper unit B. The upper unit B includes vertically movable decks 531 and 532. It further includes pickup rollers 534 and 535, a pair of separation rollers 536 and 537, conveying rollers 538 and 539, and conveying passages 542, 543, 544 and 544. A manual feeding unit C is disposed at the top of the upper unit B. It comprises a sheet stacker 550, a pickup roller 551, a pair of separation rollers 552 and a transparent cover 553 rotatable about a pin 554.

The sheet feeding unit A has a guiding rail 525 on the top frame 524 to guide the rollers 540 at the bottom of the sheet feeding unit B. The sheet feeding unit A is supported by casters 514, and are disposed adjacent a side surface of the main assembly of the copying machine. Normally, it is locked relative to the main assembly by a locking means. The unit B is similarly locked relative to the main assembly. The decks 520, 531 and 532 are slidably supported by accurides $a_1$ and $a_2$. They are drawable in a direction perpendicular to the sheet of the drawing of FIG. 28. Therefore, the door is provided in the front side surface. When the door is opened, the decks 520, 531 and 532 can be drawn out to replenish the sheet materials to the decks. Therefore, the jam clearance within the deck can be performed when the door is opened, and the intermediate plate is lowered to lower the stacked sheet materials.

When the sheet is fed from a deck 520 of the bottommost unit A of a large capacity sheet feeding unit, pickup roller 501 feeds the sheet material (transfer sheet) 502 to the separation rollers 503. Here, the sheets are separated one by one, and the singled out sheet is conveyed to the nip between an upper waiting roller 504 and a roller waiting roller 505.

When a size of the transfer sheets contained in the lower unit A is selected, the sheet is directly fed to the registration rollers 506 of the main assembly 515 of the copying apparatus. An image is formed on the sheet through a copying process which will not be described herein in detail for simplicity. Designated by a reference numeral 530 is a photosensitive drum.

When the sheet is fed from the deck 531 or 532 of another sheet feeding unit B, the sheet is anyway fed to the upper pair of sheet conveying rollers 507 and is conveyed to the registration rollers 506 of the main assembly.

In consideration of the sheet jam occurrence, the embodiment of this invention employs the following structure for facilitating the jam clearance operation.

The guide 508, the guide 509 and the lower waiting roller 505 are left in the main assembly, and the guide 510, the guide 511 and the upper waiting roller 504 are mounted on the slidable side of the large capacity sheet feeding unit. By doing so, even if the amount of slide of the upper sheet feeding unit is not sufficient, as shown in FIG. 28, the jammed sheet can be easily removed.

The rollers 504 and 505 for gripping the transfer sheet are spaced away from each other, and the sheet passage is completely divided, so that the transfer sheet can be taken out without difficulty.

Figure 30:
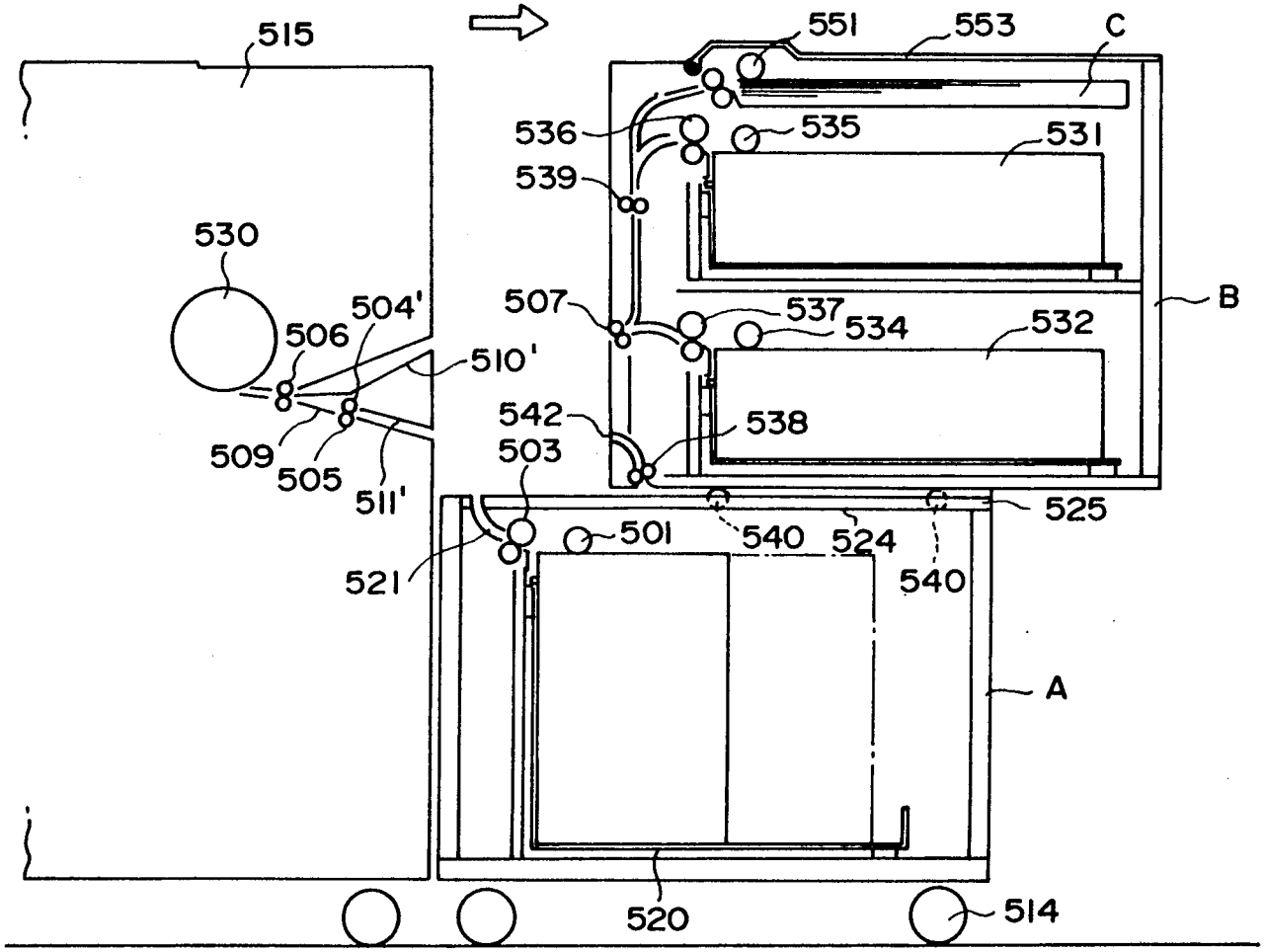
FIG. 30 is a sectional view of a sheet feeding apparatus according to a fifth embodiment of the present invention.
Figure 31:
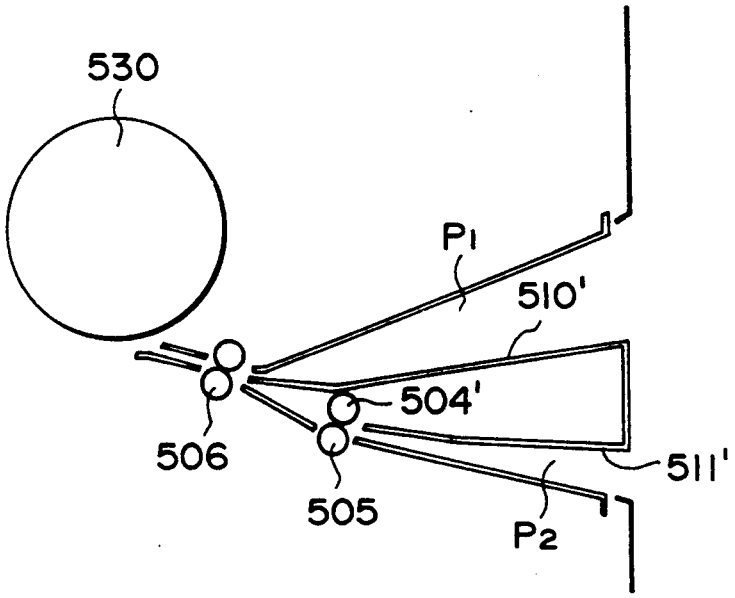
FIGS. 31 and 32 are enlarged views of a major part of the apparatus of FIG. 30.
Figure 32:
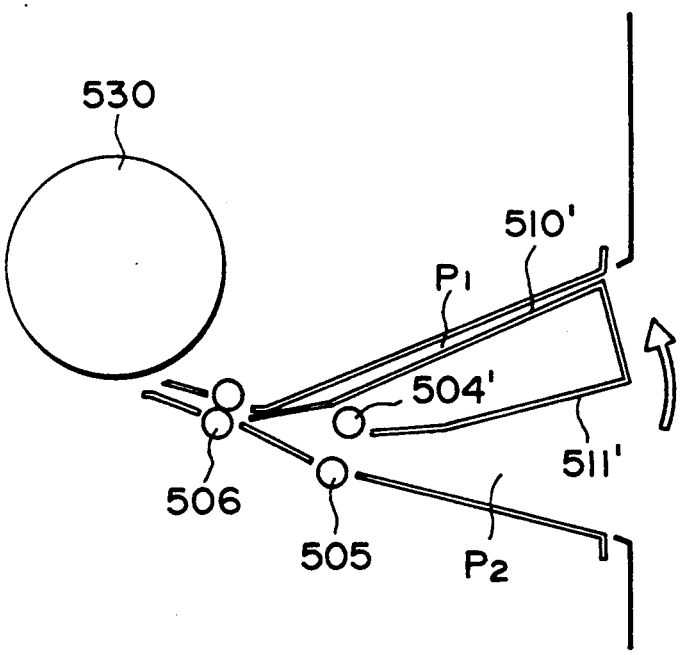

Referring to FIGS. 31 and 32, the description will be made as to a fifth embodiment. In this embodiment, the guides 510' and 511' are left in the main assembly, as shown in FIG. 30. Then, when the sheet is fed from the lower deck, the guides 510 and 511 extremely obstruct the jam clearance operation. In the structures of FIGS. 31 and 32, a swinging movement is employed. A guide 510' (lower guide of the upper passage P1), a guide 511' (an upper guide of the lower passage P2) and one 504' of waiting rollers, are integrally swingably mounted.

The clearance of the passage P2 by the guide 511' is maintained by the contact between the waiting rollers 504' and 505. The rollers 504' and 505 may be urged by a spring providing a weak spring force. Alternatively the rollers 504' and 505 may be urged by a stronger spring, and pressure releasing mechanism may be separately used.

The waiting roller 505 is a guiding roller, and the roller 504' is a follower roller. The rollers 504' and 505 function to once retain the sheet material from the sheet feeding station, and is effective when the distance from the sheet feeding station to the registration roller 506 is long. When the sheet feeding instruction is produced, the sheet material is fed from the waiting rollers 504' and 505, and therefore, the sheet feeding speed is increased.

When the sheet material is jammed in the passage P2, the guides 510' and 511' are rotated in the direction indicated by an arrow, as shown in FIG. 32, by which the space is expanded. If the jam occurs in the upper passage p1, the space is wide enough with the state of FIG. 31, and therefore, the jammed sheet can be easily taken out. The pivot may be disposed at any place, however, the pivot adjacent to the edge of the guide 510' (adjacent to the registration roller) is better since the stroke of the swinging movement can be increased.

This embodiment is advantageous in the following points.

(1) The jammed sheet in the upper sheet feeding station, the sheet feeding unit (upper) can be slid, and the operators hand can be inserted from a rear top position.

(2) In the lower sheet feeder, after the sliding movement, the guides 510', 511' and the upper waiting roller 504 can be swung upwardly.

Since the jammed sheet is not gripped by the waiting rollers, the removal of the jammed sheet is easy.

Figure 33:
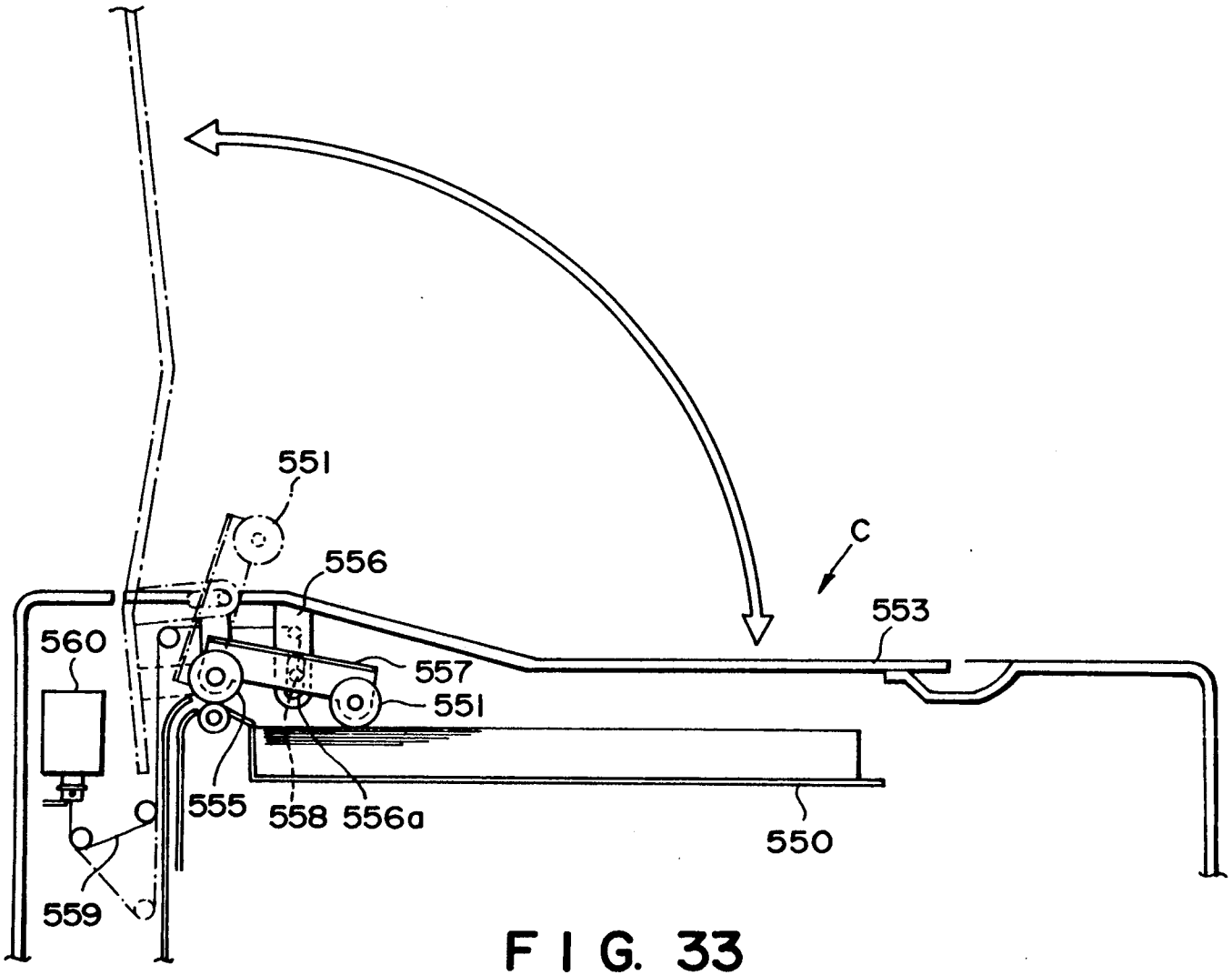
FIG. 33 shows detail of a manual feeding station.

The manual feeding station C is provided with a cover 553. When the operator wants to use it, the cover 553 is opened, as shown in FIG. 33, and the transfer sheets are set. Thereafter, the cover 553 is closed, and the manual feed mode is selected from the main assembly. The pickup roller 551 feeds the sheet out, and the sheet is supplied to the registration roller 560 of the main assembly by way of the pair of sheet feeding rollers 555, and the pair of conveying rollers 539 and 507. The main assembly 515, after detecting the transfer sheet, is controlled to be in accord with the leading edge of the image, as in the usual image forming apparatus.

In this embodiment, the manual feeding station is required to be at the top of the sheet feeding unit. It is preferable, that a transparent or at least semi-transparent cover is provided therefor. As contrasted to the other decks, the manual feeding station is usually operated with limited transfer material by the user. Therefore, it is very often that the user sets the transfer sheet, and the user takes the transfer sheets out of the manual feeding station, after the user takes the copies.

Therefore, the following is desirable:

1) The discrimination is instantaneously possible as to whether the transfer sheet is currently set or not:
2) It is positioned so that the sheet can be easily set: and
3) After the sheets are set, the number of copies can be known even during the copying operation. Therefore, the above described structure is desirable.

The cover is desirable from the standpoint of preventing introduction of foreign matter. Adjacent the sheet feeder of the image forming apparatus, staples and paper clips or other metal pieces are present naturally. If they are introduced in the sheet feeder, it or they may be fed together with the transfer sheet and may be clogged between the guides with the result of the sheet jam. If it is introduced into the main assembly, it will damage the photosensitive member, or enter the charger or the like to produce leakage of current.

The manual feeding mechanism in this embodiment is, therefore, provided with a transparent or a semi-transparent cover.

According to this embodiment:

1) The transfer sheets which are most frequently used can be accommodated in the deck of a front loading type:
2) The sheets (OHP sheet, color sheet or reproducible sheet or the like) which are less frequently used can be set during the sheet feed from another deck or during another deck not operated.
3) It is easy to discriminate what kind of transfer materials are left by the previous operator: and
4) The remaining amount of the transfer sheet can be discriminated during the copying operation.

The manual feed operation will be described. The operator first open the cover 553 to set the desired transfer material. At this time, the pickup roller 55 is supported by a pickup roller supporting member 556 mounted on the cover 553. The supporting member 557 is lifted through a pin 558. When the transfer sheets are fed out by the vertical reciprocal movement of the pickup roller 551, the pin 558 is accommodated in an elongated slot 556*a* of the supporting member 556 so as not to obstruct the sheet feeding operation. The vertical movement of the pickup roller during the sheet feeding operation, is effected by the wire 559 mounted on the pin 558, and is effected by a plunger 560.

The operator may simply place the transfer sheets on the tray 550 when the cover 553 is opened. At this time since the pickup roller 551 takes the position indicated by chain line. Therefore, it will be understood that it does not interfere the other operations.

When the sheets are set, the cover 553 is closed, by which the copying operation is possible. When the copy operation is instructed with the manual feed station, the pickup roller 51 is rotated in the clockwise direction by an unshown driving mechanism, and the transfer sheets are fed out one by one assuredly by the separation roller 555 to the main assembly.

The description will be made as to a sixth embodiment.

Figure 34:
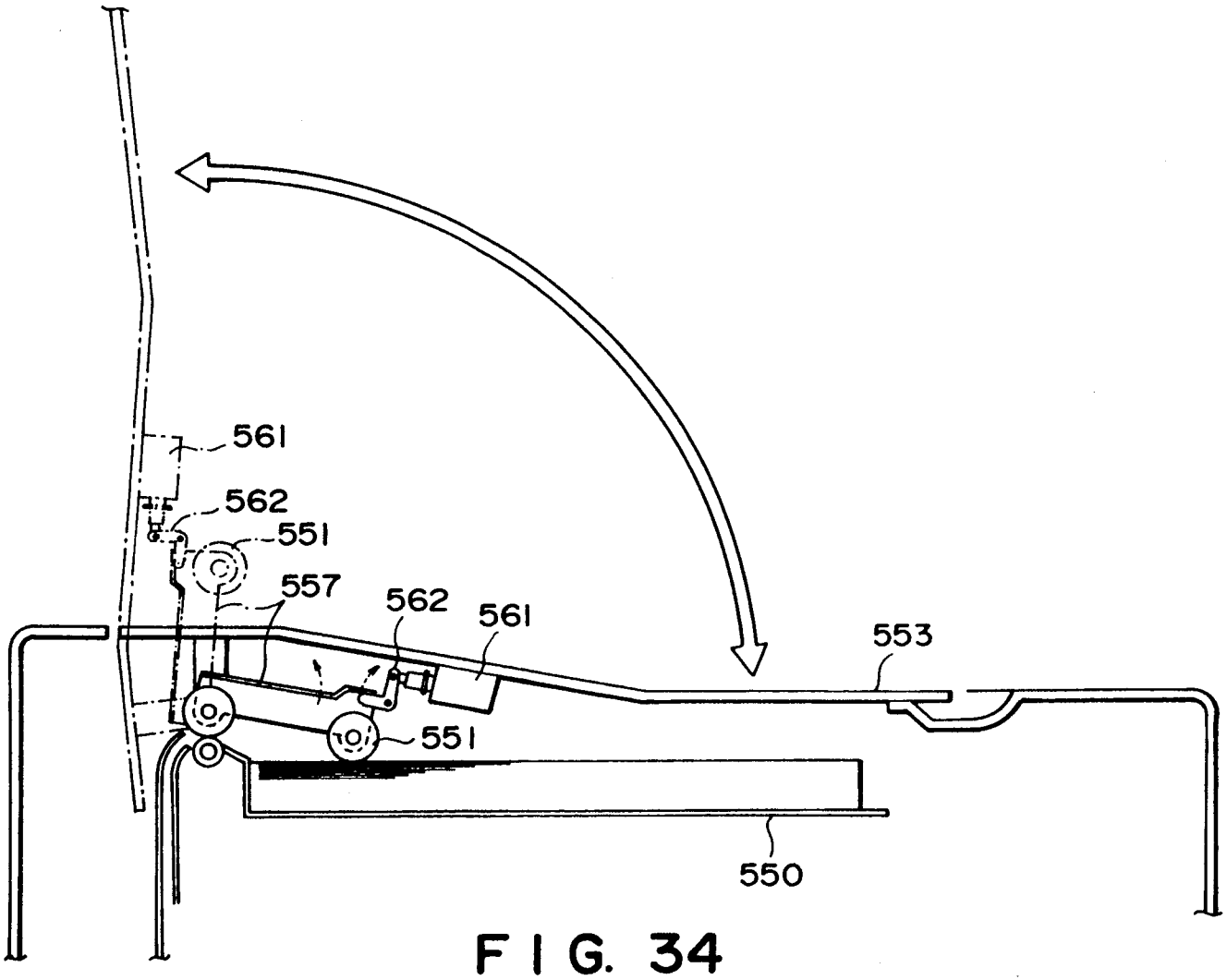
FIG. 34 is a sectional view of a part of a sheet feeding apparatus according to a sixth embodiment of the present invention.

As shown in FIG. 34, a plunger 561 for actuating the pickup roller 551 and a lever 562 are all mounted on the cover 553.

Therefore, when the operator opens the cover 553, it moves to the position indicated by chain lines in FIG. 34, and therefore, there is no obstruction to the setting of the transfer material.

Figure 35:
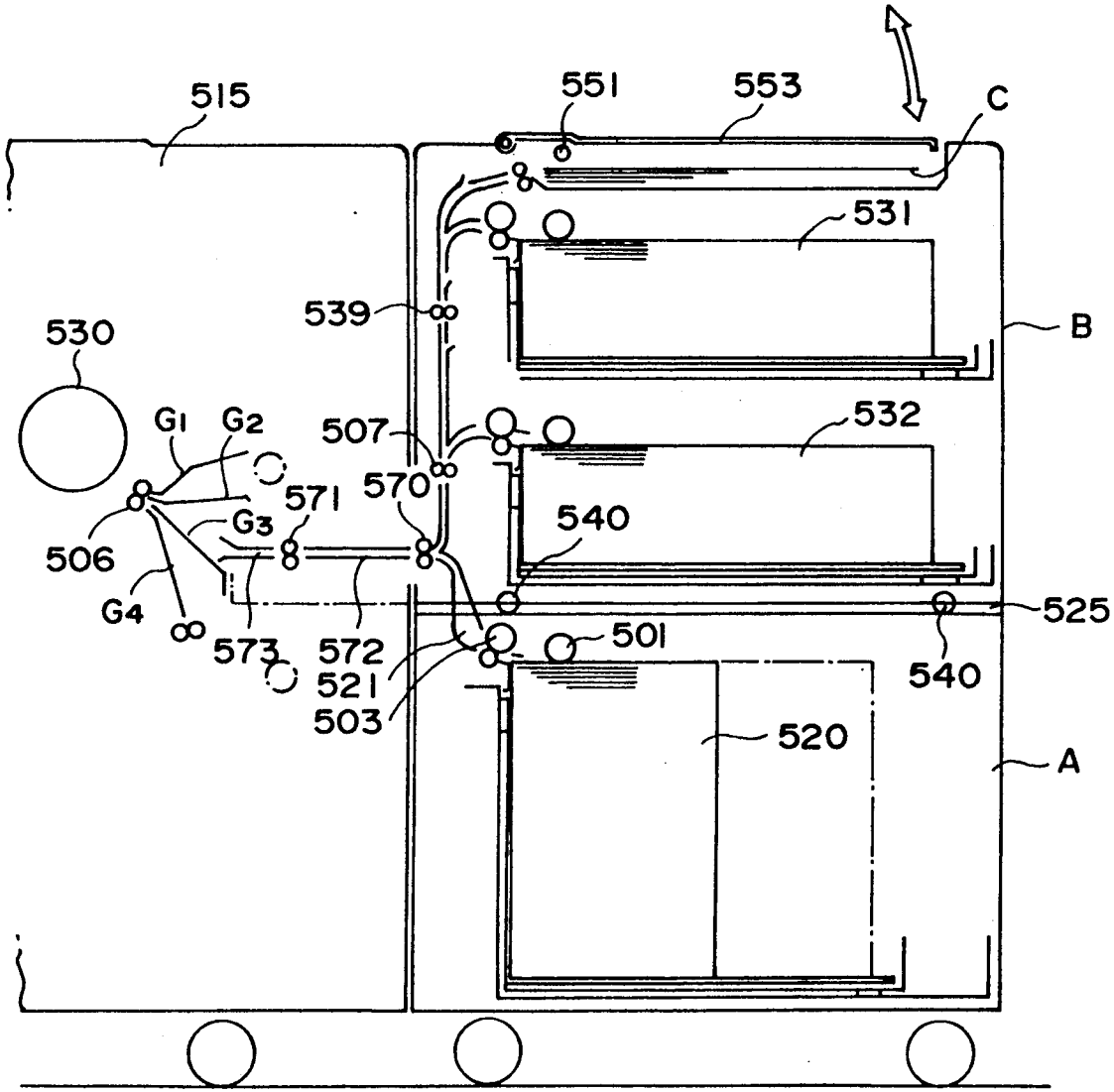
FIGS. 35 and 36 are sectional views of sheet feeding apparatuses according to seventh and eighth embodiment of the present invention.

FIG. 35 shows a seventh embodiment, wherein conveying rollers 570, 571 and guides 572 and 573 are mounted to the bottom end of the sheet feeding unit B, and the sheet material is fed to the registration roller 506 by way of guides G2 and G3 of the main assembly 515 of the copying machine.

According to this embodiment, the passages are merged into one passage, and the jam clearance operation is correspondingly easier.

Figure 36:
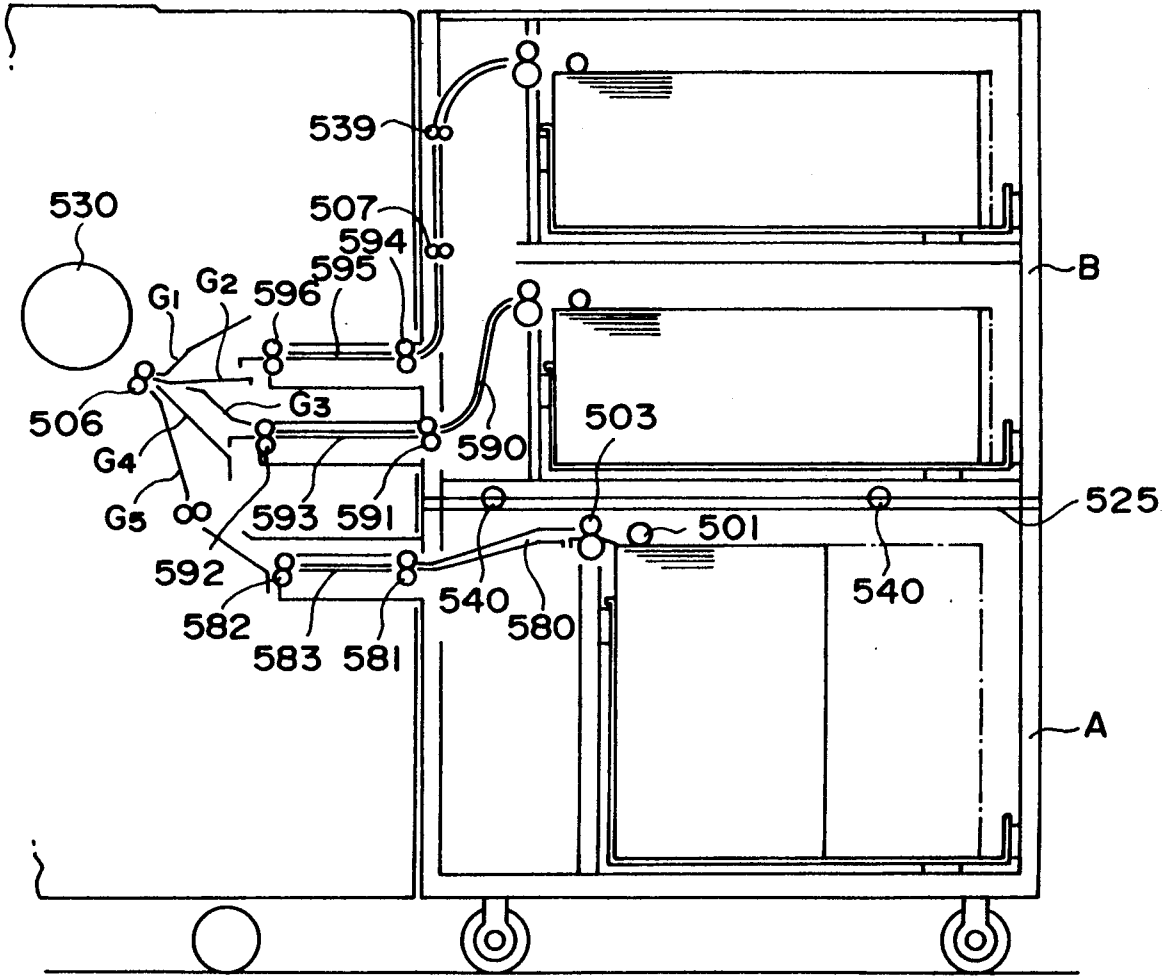

FIG. 36 shows an eighth embodiment, wherein each of the sheet feeding unit has an independent sheet passage. In the sheet feeding unit A, conveying rollers 581 and 582 and a passage 583 are projected at an end, and a passage 580 is provided inside.

In the sheet feeding unit B (upper), conveying rollers 594, 596 and a passage 595 are projected. In the sheet feeding unit B (lower), conveying rollers 591, 592 and a passage 593 are projected at an end, and there is a passage 590 inside.

In each of the foregoing embodiments, the number of decks and the number of sheet feeding rollers may be one or more in each of the upper and lower sheet feeding units.

In the foregoing embodiments, the upper sheet feeding unit is movable relative to the lower sheet feeding unit, but it is a possible alternative that the upper sheet feeding unit may be movably supported to the main assembly of the image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. A sheet feeding apparatus for feeding a sheet to a sheet processing means, comprising:

a first unit having stacking means for stacking sheets;

a first feeding means for feeding a sheet from said stacking means of said first unit;

a first sheet passage for guiding the sheet from said first feeding means to the processing means;

a second unit having stacking means for stacking sheets;

a second feeding means for feeding the sheet from said stacking means of said second unit;

a second sheet passage for guiding the sheet from said second feeding means to the processing means; and supporting means for supporting said first unit to said second unit for movement between a first position wherein said first sheet passage guides the sheet from said first feeding means and a second position wherein at least one of said first sheet passage and said second sheet passage are exposed.

2. An apparatus according to claim 1, wherein said first sheet passage has a first guiding member and a second guiding member.

3. An apparatus according to claim 2, wherein said second guiding member is integrally mounted on said first unit.

4. An apparatus according to claim 3, wherein said second guiding member is movable to an open position when said first unit is at the second position.

5. An apparatus according to claim 4, further comprising urging means for urging said second guiding member to a position for forming the first sheet passage when said first unit is at the first position.

6. An apparatus according to claim 5, wherein said urging means comprises a resilient member for urging said second guiding member.

7. An apparatus according to claim 6, further comprising a pair of conveying rotatable members for conveying the sheet, and wherein said second guiding member supports one of the rotatable members.

8. An apparatus according to claim 7, wherein one of the rotatable members supported on said second guiding member is urged to the other rotatable member by a resilient member.

9. An apparatus according to claim 8, wherein the rotatable member supported on said second guiding member is released when said first unit is at the second position.

10. An apparatus according to claim 6, wherein said resilient member is elastically deformed between the processing means and said guiding member when said first unit is at the first position.

11. An apparatus according to claim 1, wherein said supporting means slidably supports the first unit.

12. An apparatus according to claim 11, wherein said supporting means has a guiding member and a roller for sliding the first unit.

13. An apparatus according to claim 1, wherein the processing means is image forming means for forming an image on the sheet received from one of said first feeding means and said second feeding means.

14. An apparatus according to claim 1, wherein said second sheet passage includes a third guiding member and a fourth guiding member, and wherein said third guiding member is movable to an open position when said first unit is at the second position.

15. A sheet feeding apparatus for feeding a sheet to a sheet processing means, comprising:

a first unit having stacking means for stacking sheets;

a first feeding means for feeding the sheet from said stacking means of said first unit;

a first sheet passage for guiding the sheet from said first feeding means to the processing means, said sheet passage including a first guiding member and a second guiding member, said second guiding member being rotatably supported about an axis crossing with the sheet passage, and opening the sheet passage by rotation thereof;

a second unit having stacking means for stacking sheets;

a second feeding means for feeding the sheet from said stacking means of said second unit;

a second sheet passage for guiding the sheet from said second feeding means to the processing means; and supporting means for supporting said first unit on said second unit for movement between a first position in which said second member is not rotatable and a second position in which said second member is rotatable.

16. An apparatus according to claim 15, wherein said second guiding member is integrally mounted on said first unit.

17. An apparatus according to claim 15, further comprising urging means for urging said second guiding member to a position for forming the first sheet passage when said first unit is at the first position.

18. An apparatus according to claim 17, wherein said urging means comprises a resilient member for urging said second guiding member.

19. An apparatus according to claim 18, further comprising a pair of conveying rotatable members for conveying the sheet, and wherein said second guiding member supports one of the rotatable members.

20. An apparatus according to claim 19, wherein one of the rotatable members supported on said second guiding member is urged to the other rotatable member by a resilient member.

21. An apparatus according to claim 20, wherein the rotatable member supported on said second guiding member is released when said first unit is at the second position.

22. An apparatus according to claim 18, wherein said resilient member is elastically deformed between the processing means and said second guiding member when said first unit is at the first position.

23. An apparatus according to claim 15, wherein said supporting means slidably supports the first unit.

24. An apparatus according to claim 22, wherein said supporting means has a guiding member and a roller for sliding the first unit.

25. An apparatus according to claim 15, wherein the processing means is image forming means for forming an image on the sheet from one of said first feeding means and said second feeding means.

26. An apparatus according to claim 15, wherein said second sheet passage includes a third guiding member and a fourth guiding member, and wherein said third guiding member is movable to an open position when said first unit is at the second position.

27. A sheet feeding apparatus for feeding a sheet to a sheet processing means, comprising:

a first unit having stacking means for stacking sheets;

a first feeding means for feeding the sheet from said stacking means of said first unit;

a first sheet passage for guiding the sheet from said first feeding means to the processing means, said first sheet passage including a first guiding member and a second guiding member, said second guiding member being movable to a position for opening said sheet passage;

a second unit having stacking means for stacking sheets;

a second feeding means for feeding the sheet from said stacking means of said second unit;

a second sheet passage for guiding the sheet from said second feeding means to the processing means;

supporting means for supporting said first unit on said second unit for movement between a first position in which said second guiding member is not rotatable and a second position in which said second guiding member is rotatable; and urging means for urging said second guiding member to a position for forming the first sheet passage when said first unit is at the first position.

28. An apparatus according to claim 27, wherein said urging means comprises a resilient member for urging said second guiding member.

29. An apparatus according to claim 28, further comprising a pair of conveying rotatable members for conveying the sheet, and wherein said second guiding member supports one of the rotatable members.

30. An apparatus according to claim 29, wherein one of the rotatable members supported on said second guiding member is urged to the other rotatable member by a resilient member.

31. An apparatus according to claim 30, wherein the rotatable member supported on said second guiding member is released when said first unit is at the second position.

32. An apparatus according to claim 31, wherein said resilient member is elastically deformed between the processing means and said guiding member when said first unit is at the first position.

33. An apparatus according to claim 27, wherein said supporting means slidably supports the first unit.

34. An apparatus according to claim 33, wherein said supporting means has a guiding member and a roller for sliding the first unit.

35. An apparatus according to claim 27, wherein the processing means is image forming means for forming an image on the sheet from one of said first feeding means and said second feeding means.

36. An apparatus according to claim 27, wherein said second sheet passage includes a third guiding member and a fourth guiding member, and wherein said third guiding member is movable to an open position when said first unit is at the second position.

37. An image forming apparatus, comprising:

image forming means for forming an image on a sheet;

a first unit having stacking means for stacking sheets;

a first feeding means for feeding the sheet from said stacking means of said first unit;

a first sheet passage for guiding the sheet from said first feeding means to said image forming means;

a second unit having stacking means for stacking sheets;

a second feeding means for feeding the sheet from said stacking means of said second unit;

a second sheet passage for guiding the sheet from said second feeding means to the image forming means; and supporting means for supporting said first unit to said second unit for movement between a first position wherein said first sheet passage guides the sheet from said first feeding means and a second position wherein at least one of said first sheet passage and said second sheet passage are exposed.

38. An apparatus according to claim 37, wherein said second sheet passage includes a third guiding member and a fourth guiding member, and wherein said third guiding member is movable to an open position when said first unit is at the second position.

39. A sheet feeding apparatus for feeding a sheet to a sheet receiving means, comprising:

a first unit having stacking means for stacking sheets;

a first feeding means for feeding the sheet from said stacking means of said first unit;

a first sheet passage for guiding the sheet from said first feeding means to the processing means;

a second unit having stacking means for stacking sheets;

a second feeding means for feeding the sheet from said stacking means of said second unit;

a second sheet passage for guiding the sheet from said second feeding means to the processing means; and supporting means for supporting said first unit on said second unit for movement between a first position wherein said first passage is capable of guiding the sheet and a second position wherein said first passage is incapable of guiding the sheet.

40. An apparatus according to claim 39, wherein said first sheet passage has a first guiding member and a second guiding member.

41. An apparatus according to claim 40, wherein said second guiding member is integrally mounted on said first unit.

42. An apparatus according to claim 41, wherein said second guiding member is movable to an open position when said first unit is at the second position.

43. An apparatus according to claim 42, further comprising urging means for urging said second guiding member to a position for forming the first sheet passage when said first unit is at the first position.

44. An apparatus according to claim 43, wherein said urging means comprises a resilient member for urging said second guiding member.

45. An apparatus according to claim 44, further comprising a pair of conveying rotatable members for conveying the sheet, and wherein said second guiding member supports one of the rotatable members.

46. An apparatus according to claim 45, wherein one of the rotatable members supported on said second guiding member is urged to the other rotatable member by a resilient member.

47. An apparatus according to claim 46, wherein the rotatable member supported on said second guiding member is released when said first unit is at the second position.

48. An apparatus according to claim 47, wherein said resilient member is elastically deformed between the processing means and said guiding member when said first unit is at the first position.

49. An apparatus according to claim 48, wherein said supporting means slidably supports the first unit.

50. An apparatus according to claim 49, wherein said supporting means has a guiding member and a roller for sliding the first unit.

51. An apparatus according to claim 39, wherein the processing means is image forming means for forming an image on the sheet from one of the first feeding means and the second feeding means.

52. An apparatus according to claim 39, wherein said second sheet passage includes a third guiding member and a fourth guiding member, and wherein said third guiding member is movable to an open position when said first unit is at the second position.

* * * * *

UNITED STATES PATENT AND TRADEMARK OFFICE

CERTIFICATE OF CORRECTION

PATENT NO. : 5,203,552

DATED : April 20, 1993

INVENTOR(S) : HOSHI ET AL.

It is certified that error appears in the above-indentified patent and that said Letters Patent is hereby corrected as shown below:

COLUMN 1

Line 19, "sheet" should read --sheets--.
Line 20, "increased," should read --increases,--.
Line 22, "required" should read --requires--; and "move" should read --to move--.

COLUMN 2

Line 28, "to" should read --to a--.
Line 38, "a" should be deleted--.
Line 57, "a" should be deleted--.

COLUMN 3

Line 32, "the" should be deleted.
Line 41, "cover" should read --covers--.
Line 63, "ar" should read --are--.
Line 68, "is" should read --are--.

COLUMN 5

Line 42, "Fig. 4" should read --Fig. 4,--.
Line 60, "T" should read --To--.

COLUMN 6

Line 6, "ends" should read --end--.
Line 30, "directions," should read --direction,--.
Line 52, "rows 141." should read --row 141.--.

UNITED STATES PATENT AND TRADEMARK OFFICE

CERTIFICATE OF CORRECTION

PATENT NO. : 5,203,552
DATED : April 20, 1993
INVENTOR(S) : HOSHI ET AL.

It is certified that error appears in the above-indentified patent and that said Letters Patent is hereby corrected as shown below:

COLUMN 7

Line 11, "b" should read --by--.

COLUMN 8

Line 3, "push" should read --pushes--; and "lift" should read --lifts--.
Line 26, "its" should read --it--.
Line 33, "rotate" should read --rotates--.

COLUMN 9

Line 3, "lowers" should read --lowered--.
Line 22, "is" should read --are--.
Line 34, "portion 130" should read --portion 130,--.

COLUMN 10

Line 17, "detects" should read --detecting--.
Line 22, after "structure" insert --like--.
Line 40, "any" should read --if any--.
Line 42, "deck" should read --decks--.

COLUMN 12

Lines 65-67 should read as follows: --An end portion of a horizontal portion of an "L"-shaped abutment member 259 engages an elongated slot 257 formed in the link 256 adjacent its bottom end. An oper- --.

UNITED STATES PATENT AND TRADEMARK OFFICE

CERTIFICATE OF CORRECTION

PATENT NO. : 5,203,552

DATED : April 20, 1993

INVENTOR(S) : HOSHI ET AL.

It is certified that error appears in the above-indentified patent and that said Letters Patent is hereby corrected as shown below:

COLUMN 13

Line 61, "to" should read --too--.

COLUMN 14

Line 36, "cant." should read --cance--.
Line 37, "is" should read --are--.

COLUMN 15

Line 33, "copies" should read "copy--.
Line 38, "is" should be deleted.

COLUMN 16

Line 2, "a" should read --as--.
Line 61, "involves" should read --involved--.
Line 63, "since" should be deleted.

COLUMN 17

Line 16, "one" should read --a one--.
Line 17, "made" should read --make--.
Line 34, "date" should read --dates--.

COLUMN 18

Line 59, "a to" should read --as to--.

COLUMN 20

Line 25, "and" (second occurrence) should be deleted.

UNITED STATES PATENT AND TRADEMARK OFFICE

CERTIFICATE OF CORRECTION

PATENT NO. : 5,203,552

DATED : April 20, 1993

INVENTOR(S) : HOSHI ET AL.

It is certified that error appears in the above-indentified patent and that said Letters Patent is hereby corrected as shown below:

COLUMN 21

Line 1, "a" should be deleted.
Line 11, "is" should read --is a--; and "rollers" should read --roller--.

COLUMN 22

Line 1, "light," should read --right,--.
Line 24, "multi-stage" should read --a multi-stage--.
Line 58, "this" should read --these--.

COLUMN 23

Line 16, "and 544" should read --and 545--.
Line 24, "are" should read --is--.
Line 29, "accurides" should read --guides--.
Line 44, "roller" (first occurrence) should read --lower--.

COLUMN 24

Line 23, "is" should read --are--.

COLUMN 25

Line 39, "open" should read --opens--.
Line 55, "interfere" should read --interfere with--.

UNITED STATES PATENT AND TRADEMARK OFFICE

CERTIFICATE OF CORRECTION

PATENT NO. : 5,203,552 Page 5 of 5

DATED : April 20, 1993

INVENTOR(S) : HOSHI ET AL.

It is certified that error appears in the above-indentified patent and that said Letters Patent is hereby corrected as shown below:

COLUMN 26

Line 15, "unit" should read --units--.

COLUMN 29

Line 53, "receiving" should read --processing--.

Signed and Sealed this

Fifth Day of April, 1994

Bruce Lehman

*Attest:*

BRUCE LEHMAN

*Attesting Officer*

*Commissioner of Patents and Trademarks*